US008174200B2

(12) United States Patent
Kosaka et al.

(10) Patent No.: US 8,174,200 B2
(45) Date of Patent: May 8, 2012

(54) PIEZOELECTRIC TRANSFORMER DRIVING DEVICE, COLD-CATHODE TUBE INVERTER, COLD-CATHODE TUBE DRIVING DEVICE, AND IMAGE FORMING APPARATUS

(75) Inventors: Toru Kosaka, Tokyo (JP); Masao Yaji, Tokyo (JP); Akira Hagiwara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 299 days.

(21) Appl. No.: 12/694,321

(22) Filed: Jan. 27, 2010

(65) Prior Publication Data

US 2010/0188011 A1 Jul. 29, 2010

(30) Foreign Application Priority Data

Jan. 28, 2009 (JP) ..... 2009-016766

(51) Int. Cl.
*H05B 37/02* (2006.01)
*H01J 29/96* (2006.01)

(52) U.S. Cl. ..... 315/209 PZ; 315/3

(58) Field of Classification Search ..... 315/209 PZ, 315/209 SC, 209 M, 1, 3, 291, 200 R, 276
See application file for complete search history.

(56) References Cited

U.S. PATENT DOCUMENTS 6,486,612 B2 * 11/2002 Fujimura et al. ..... 315/225
6,654,221 B2 * 11/2003 Noma et al. ..... 361/91.1
6,720,705 B2 * 4/2004 Nakatsuka et al. ..... 310/316.01
6,794,796 B2 * 9/2004 Nakatsuka et al. ..... 310/316.01

FOREIGN PATENT DOCUMENTS

JP 2006-091757 A 4/2006

* cited by examiner

*Primary Examiner* — Douglas W Owens
*Assistant Examiner* — Minh D A
(74) *Attorney, Agent, or Firm* — Marvin A. Motsenbocker; Mots Law, PLLC

(57) ABSTRACT

A piezoelectric transformer driving device including: an oscillator; a frequency-divider outputting a pulse by dividing a clock signal from the oscillator by a frequency-divide ratio received thereto; a switching element driven by the pulse and intermittently applying a voltage to a primary side of a piezoelectric transformer; a frequency-divide ratio instructing unit holding a frequency-divide ratio instruction value of a real number having an integer part and an fractional part; a binarization unit binarizing the frequency-divide ratio instruction value into two different integer frequency-divide ratios and selectively outputting the frequency-divide ratios. The binarization unit adjusts an appearance ratio of the frequency-divide ratios such that an average of the frequency-divide ratios output from the binarization unit is equal to an average of the frequency-divide ratio instruction value.

14 Claims, 19 Drawing Sheets

TRANSFER HIGH VOLTAGE POWER SUPPLY OF FIRST EMBODIMENT

TRANSFER HIGH VOLTAGE POWER SUPPLY SHOWN IN FIG. 1

IMAGE FORMING APPARATUS OF FIRST EMBODIMENT

OUTPUT VOLTAGE / FREQUENCY CHARACTERISTIC OF PIEZOELECTRIC TRANSFORMER SHOWN IN FIG. 2

OPERATIONAL WAVEFORM OF TRANSFER HIGH VOLTAGE POWER SUPPLY OF FIG. 2

FIG. 8

| ERROR HOLDING REGISTOR | THE LOWER 10 bits IN 19-bit REGISTER | OUTPUT OF COMPARISON UNIT 63-2 |
|---|---|---|
| 0 | 300 | 1 |
| -(1024 x 1)+0+300 = -724 | 300 | 0 |
| -(1024 x 0)+(-724)+300=-424 | 300 | 0 |
| -(1024 x 0)+(-424)+300= -124 | 300 | 0 |
| -(1024 x 0)+(-124)+300= 224 | 300 | 1 |
| -(1024 x 1)+224+300= -500 | 300 | 0 |
| -(1024 x 0)+(-500)+300= -200 | 300 | 0 |
| -(1024 x 0)+(-200)+300= 100 | 300 | 1 |
| -(1024 x 1)+100+300= -624 | 300 | 0 |
| -(1024 x 0)+(-624)+300= -324 | 300 | 0 |
| -(1024 x 0)+(-324)+300= -24 | 300 | 0 |
| -(1024 x 0)+(-24)+300= 276 | 300 | 1 |
| -(1024 x 0)+276+300= -448 | 300 | 0 |

RELATIONSHIP AMONG ERROR HOLDING REGISTOR 72, THE LOWER 10 BITS IN 19-bit REGISTER 67, AND OUTPUT VALUE OF SIGNAL COMPARISON UNIT 63-2, SHOWN IN FIG. 6

HIGH VOLTAGE CONTROLLER OF SECOND EMBODIMENT

FIG. 10

| ERROR HOLDING REGISTOR | THE LOWER 10 BITS IN 19-bit REGISTER | OUTPUT OF COMPARISON UNIT 63–2 | 3-bit REGISTOR VALUE |
|---|---|---|---|
| 0 | 300 | 1 | 000b |
| –(448 x 1)–(320 x 0)–(192 x 0)–(64 x 0)+0+300= –148 | 300 | 0 | 100b |
| –(448 x 0)–(320 x 1)–(192 x 0)–(64 x 0)+(–148)+300= –168 | 300 | 0 | 010b |
| –(448 x 0)–(320 x 0)–(192 x 1)–(64 x 0)+(–168)+300= –60 | 300 | 0 | 001b |
| –(448 x 0)–(320 x 0)–(192 x 0)–(64 x 1)+(–60)+300= 176 | 300 | 1 | 000b |
| –(448 x 1)–(320 x 0)–(192 x 0)–(64 x 0)+176+300= 28 | 300 | 1 | 100b |
| –(448 x 1)–(320 x 1)–(192 x 0)–(64 x 0)+28+300= 440 | 300 | 0 | 110b |
| –(448 x 0)–(320 x 1)–(192 x 1)–(64 x 0)+(–440)+300= –652 | 300 | 0 | 011b |
| –(448 x 0)–(320 x 0)–(192 x 1)–(64 x 1)+(–652)+300= –608 | 300 | 0 | 001b |
| –(448 x 0)–(320 x 0)–(192 x 0)–(64 x 1)+(–608)+300= –372 | 300 | 0 | 000b |
| –(448 x 0)–(320 x 0)–(192 x 0)–(64 x 0)+(–372)+300= –72 | 300 | 0 | 000b |
| –(448 x 0)–(320 x 0)–(192 x 0)–(64 x 0)+(–72)+300= 228 | 300 | 1 | 000b |
| –(448 x 1)–(320 x 0)–(192 x 0)–(64 x 0)+228+300= 80 | 300 | 1 | 100b |
| –(448 x 1)–(320 x 1)–(192 x 0)–(64 x 0)+80+300= –388 | 300 | 0 | 110b |
| –(448 x 0)–(320 x 1)–(192 x 1)–(64 x 0)+(–388)+300= –600 | 300 | 0 | 011b |
| –(448 x 0)–(320 x 0)–(192 x 1)–(64 x 1)+(–600)+300= –556 | 300 | 0 | 001b |
| –(448 x 0)–(320 x 0)–(192 x 0)–(64 x 0)+(–556)+300= –320 | 300 | 0 | 000b |
| –(448 x 0)–(320 x 0)–(192 x 0)–(64 x 0)+(–320)+300= –20 | 300 | 0 | 000b |
| –(448 x 0)–(320 x 0)–(192 x 0)–(64 x 0)+(–20)+300= 280 | 300 | 1 | 000b |
| –(448 x 1)–(320 x 0)–(192 x 0)–(64 x 0)+280+300= 132 | 300 | 1 | 100b |

OPERATION OF ARITHMETIC UNIT SHOWN IN FIG. 9

HIGH VOLTAGE CONTROLLER OF THIRD EMBODIMENT

HIGH VOLTAGE CONTROLLER OF FOURTH EMBODIMENT 6-bits PSEUDORANDOM NUMBER GENERATOR SHOWN IN FIG. 12

HIGH VOLTAGE CONTROLLER OF FIFTH EMBODIMENT

CONTROL CIRCUIT OF FIG. 15

COLD-CATHODE TUBE DRIVING UNIT ACCORDING TO SIXTH EMBODIMENT

COLD-CATHODE TUBE DRIVING UNIT OF FIG. 17

OPERATIONAL WAVEFORM OF COLD-CATHODE TUBE DRIVING UNIT OF FIG. 18

PIEZOELECTRIC TRANSFORMER DRIVING DEVICE, COLD-CATHODE TUBE INVERTER, COLD-CATHODE TUBE DRIVING DEVICE, AND IMAGE FORMING APPARATUS

CROSS REFERENCE TO RELATED APPLICATIONS

This application claims priority based on 35 USC 119 from prior Japanese Patent Application No. 2009-016766 filed on Jan. 28, 2009, entitled "piezoelectric transformer driving device, cold-cathode tube inverter, cold-cathode tube driving device and image forming apparatus", the entire contents of which are incorporated herein by reference.

BACKGROUND OF THE INVENTION

1. Field of the Invention

The invention relates to a piezoelectric transformer driving device operable to drive a piezoelectric transformer, a cold-cathode tube inverter and a cold-cathode tube driving device that are operable to drive a cold-cathode tube using the piezoelectric transformer driving device, and an electrophotographic image forming apparatus using the piezoelectric transformer driving device, the cold-cathode tube inverter, or the cold-cathode tube driving device.

2. Description of Related Art

A conventional power supply device used for an electrophotographic image forming apparatus has been known, in which an output signal of a piezoelectric transformer driving device, which comprises a voltage-controlled oscillator (hereinafter "VCO"), controls a piezoelectric transformer, which can transform a low voltage input to a high voltage output using a resonant oscillation of a voltage oscillator, so as to output a high voltage (for example, Japanese Patent Application Laid-Open No. 2006-91757).

SUMMARY OF THE INVENTION

The conventional piezoelectric transformer-driving device has the following problems (a) to (c).

(a): The conventional piezoelectric transformer-driving device is composed of many parts because it is an analog circuit including VCO or the like.

(b): It is difficult to reduce the characteristic variation of the piezoelectric transformer due to its variation.

(c): It is difficult to design a digital piezoelectric transformer driving device, because the digital piezoelectric transformer driving device requires an oscillator having several hundred MHz to GHz for driving the piezoelectric transformer at the required frequency resolution.

A first aspect of the invention is a piezoelectric transformer driving device including: an oscillator configured to generate a clock signal; a frequency-divide ratio instructing unit configured to hold a frequency-divide ratio instruction value of a real number having an integer part and a fractional part; a binarization unit configured to binarize the frequency-divide ratio instruction value into two different integer frequency-divide ratios $\alpha$ and $\beta$ and to selectively output the frequency-divide ratios $\alpha$ or $\beta$, wherein the binarization unit adjusts the appearance ratio of the frequency-divide ratios $\alpha$ and $\beta$ such that a fractional part of the average value per unit time of the frequency-divide ratio output from the binarization unit is equal to the fractional part of an average value per unit time of the frequency-divide ratio instruction value; a frequency-divider configured to output a pulse by dividing the clock signal by the frequency-divide ratios that are output from the binarization unit; and a switching element configured to be driven by the pulse and to intermittently apply a voltage to the primary side of a piezoelectric transformer so as to output a high voltage alternate current from the secondary side of the piezoelectric transformer.

A second aspect of the invention is a piezoelectric transformer driving device including: an oscillator configured to generate a clock signal; a frequency-divide ratio instructing unit configured to hold a frequency-divide ratio instruction value of a real number having an integer part and a fractional part; a multinarization unit configured to convert the frequency-divide ratio instruction value into three or more different integer frequency-divide ratios and to selectively output the frequency-divide ratios such that an average of the frequency-divide ratios output from the multinarization unit is equal to the frequency-divide ratio instruction value; and a frequency-divider configured to generate a pulse by dividing the clock signal by the frequency-divide ratio that is output from the binarization unit; and a switching element configured to be driven by the pulse and to intermittently apply a voltage to the primary side of a piezoelectric transformer so as to output a high voltage alternate current from the secondary side of the piezoelectric transformer.

A third aspect of the invention is an image forming apparatus including an image forming power supply having the piezoelectric transformer driving device of the first aspect to generate a high voltage for forming an image.

A fourth aspect of the invention is a cold-cathode tube inverter including the piezoelectric transformer driving device of the first aspect or the second aspect to drive a cold-cathode tube.

A fifth aspect of the invention is an image forming apparatus including a cold-cathode driving power supply having the cold-cathode tube inverter of the fourth aspect to generate the high voltage for lighting the cold-cathode.

A sixth aspect of the invention is a cold-cathode tube driving device including: the cold-cathode tube inverter of the fourth aspect; a tube current detector configured to detect the voltage of the electric current flowing through the cold-cathode tube and to output the detected voltage; a rectifier configured to output a DC voltage by rectifying the detected voltage; a target voltage instructing unit configured to output a target voltage; and a voltage comparison unit configured to compare the DC voltage output from the rectifier with the target voltage output from the target voltage instructing unit and to output the comparison result, wherein the frequency-divide ratio of the frequency-divide ratio instructing unit is controlled such that the comparison result is a rectangular wave.

An seventh aspect of the invention is an image forming apparatus including: the image forming power supply according to the third aspect; and an image read device including one of the cold-cathode driving power supply according to the fifth aspect and the cold-cathode tube driving device according to the sixth aspect, wherein one integrated circuit outputs the pulse driving the piezoelectric transformer of the image forming power supply and the pulse driving the piezoelectric transformer of the one of the cold-cathode driving power supply according to the fifth aspect or the cold-cathode tube driving device according the sixth aspect.

BRIEF DESCRIPTION OF THE DRAWINGS

FIG. 8 is a table showing the relationship between the value of error holding register 72 shown in FIG. 6, the lower 10-bit value in 19-bit register 67 shown in FIG. 6, and an output signal of comparison unit 63-2 shown in FIG. 6.

FIG. 10 is a table explaining an operation of an arithmetic unit 71A shown in FIG. 9.

DETAILED DESCRIPTION OF EMBODIMENTS

Figure 1:
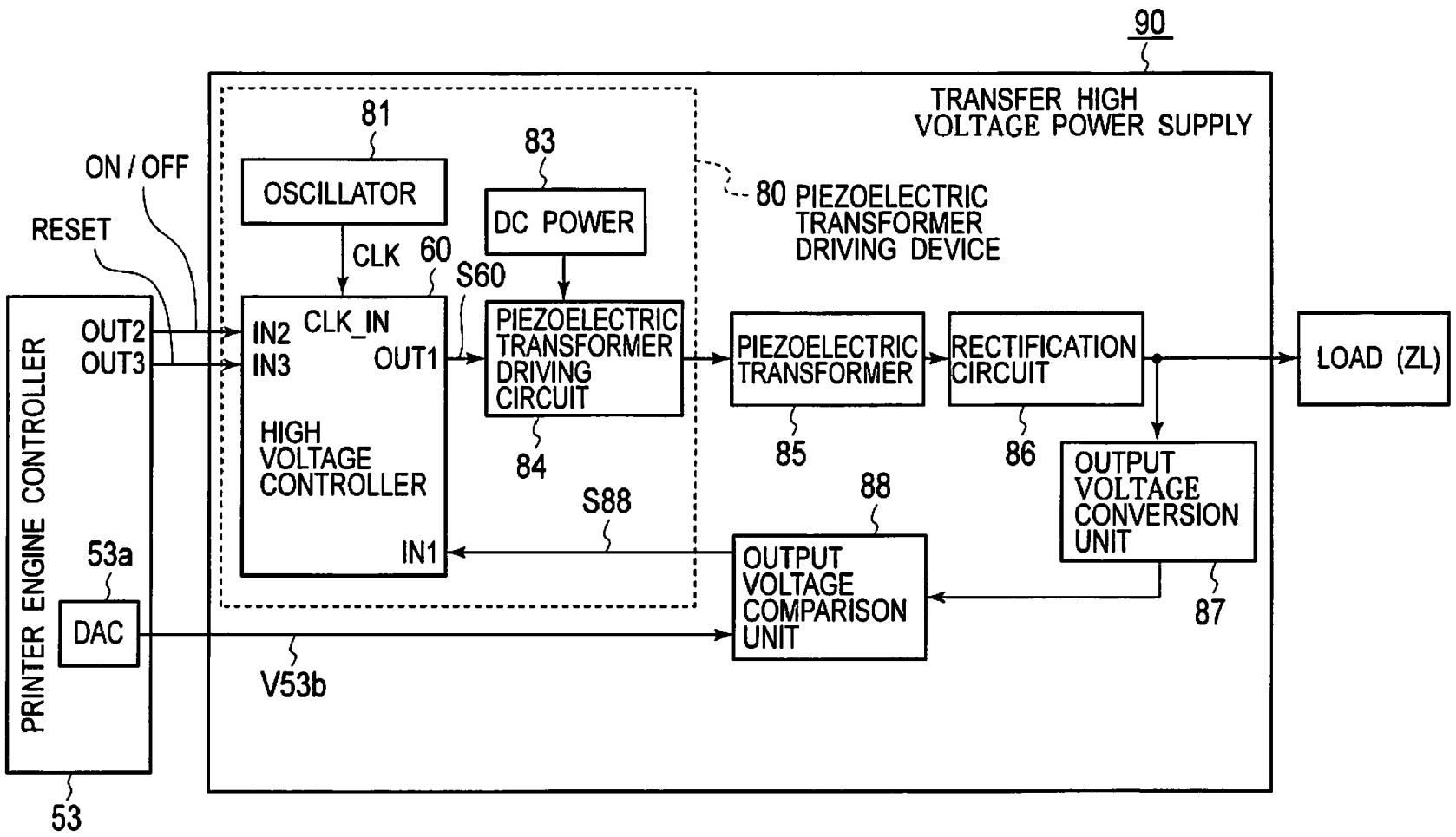
FIG. 1 is a block diagram of a transfer high voltage power supply having a piezoelectric transformer-driving device according to a first embodiment of the invention.

Descriptions are provided herein below for embodiments based on the drawings. In the respective drawings referenced herein, the same constituents are designated by the same reference numerals and duplicate explanation concerning the same constituents is omitted. All of the drawings are provided to illustrate the respective examples only.

[First Embodiment]

(Configuration of Image Forming Apparatus)

Figure 3:
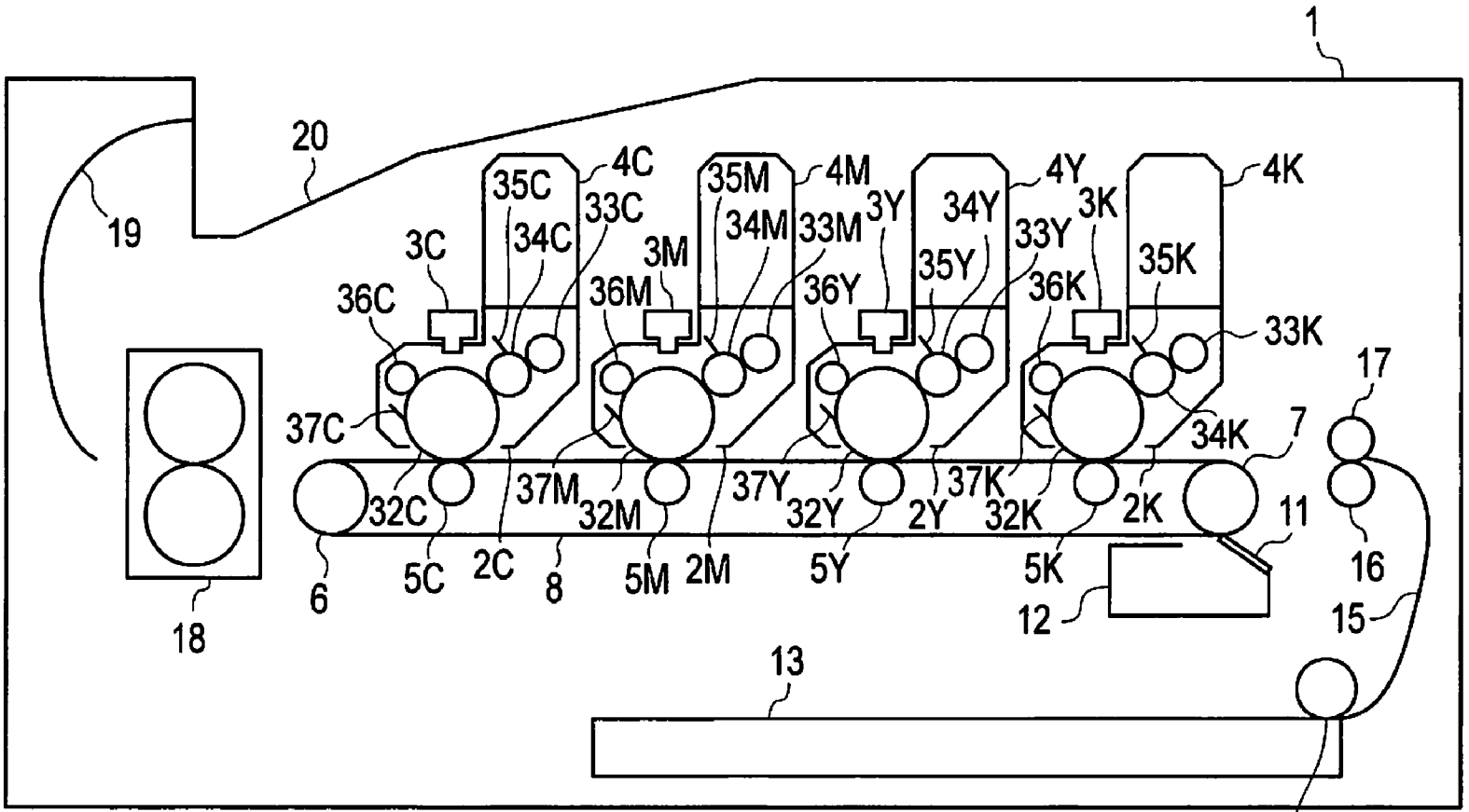
FIG. 3 is a block diagram of image forming apparatus 1 using a power supply device according to the first embodiment of the invention.

FIG. 3 is a block diagram of image forming apparatus 1 using a power supply device according to the first embodiment of the invention.

Image forming apparatus 1 is a color electrophotographic image forming apparatus in this embodiment. Image forming apparatus 1 includes developing units 2K, 2Y, 2M, and 2C, image transfer unit (image transfer rollers 5K, 5Y, 5M, 5C, image transfer belt driving roller 6, image transfer belt driven roller 7, image transfer belt 8), fixing unit 18, paper cassette 13, hopping roller 14, and resist rollers 16 and 17. Developing unit 2K for black toner, developing unit 2Y for yellow toner, developing unit 2M for magenta toner, and developing unit 2C for cyan toner are detachably attached to the body of image forming apparatus 1. Developing units 2K, 2Y, 2M, and 2C respectively include photosensitive drums 32K, 32Y, 32M, and 32C, charging rollers 36K, 36Y, 36M, and 36C, supplying rollers 33K, 33Y, 33M, and 33C, developing rollers 34K, 34Y, 34M, and 39C, development blades 35K, 35Y, 35M, and 35C, and cleaning blade 37K, 37Y, 37M, and 37C. Photosensitive drums 32K, 32Y, 32M, and 32C are in contact with charging rollers 36K, 36Y, 36M, and 36C respectively such that photosensitive drums 32K, 32Y, 32M, and 32C are uniformly charged by charging rollers 36K, 36Y, 36M, and 36C. Light emitting element (hereinafter "LED") head 3K for black image, LED head 3Y for yellow image, LED head 3M for magenta image, and LED head 3C for cyan image emit light onto charged photosensitive drums 32K, 32Y, 32M, and 32C, respectively, so that latent images are formed on charged photosensitive drums 32K, 32Y, 32M, and 32C, respectively.

Supplying rollers 33K, 33Y, 33M, 33C supply toner to developing rollers 34K, 34Y, 34M, and 34C, respectively. The respective color toners supplied to developing rollers 34K, 34Y, 34M, and 34C are metered by development blades 35K, 35Y, 35M, and 35C, respectively, thereby forming uniform thickness toner layers on developing rollers 34K, 34Y, 34M, and 34C. The toner layers on developing rollers 34K, 34Y, 34M, and 34C are electrostatically attracted to the latent images formed on photosensitive drums 32K, 32Y, 32M, and 32C, so as to develop the latent images, that is, form respective color toner images on photosensitive drums 32K, 32Y, 32M, and 32C, respectively. The respective color toner images are transferred to a paper sheet by an image transfer unit (5K, 5Y, 5M, 5C, 6, and 7) thereby forming multi-color toner image on the paper sheet. After transfer of the toner images from photosensitive drums 32K, 32Y, 32M, and 32C to the paper sheet, cleaning blades 37K, 37Y, 37M, and 37C remove any toner remaining on photosensitive drums 32K, 32Y, 32M, and 32C.

Black toner cartridge 4K, yellow toner cartridge 4Y, magenta toner cartridge 4M, and cyan toner cartridge 4C are detachably mounted to developing unit 2K, 2Y, 2M, and 2C, respectively, such that the toner contained in toner cartridges 4K, 4Y, 4M, and 4C can be supplied to developing units 2K, 2Y, 2M, and 2C, respectively. Image transfer roller 5K for a black toner image, image transfer roller 5Y for a yellow toner image, image transfer roller 5M for a magenta toner image, and transfer roller 5C for a cyan toner image are disposed inside transfer belt 8 such that transfer rollers 5K, 5Y, 5M, and 5C can apply bias voltages to transfer nips between the outside of transfer belt 8 and photosensitive drums 32K, 32Y, 32M, and 32C. Image transfer belt driving roller 6 and image transfer belt driven roller 7 support image transfer belt 8 extending there-between such that these rollers 6 and 7 drive image transfer belt 8 to rotate for conveying paper sheet 15 on image transfer belt 8.

Image transfer belt cleaning blade 11 scraps any toner remaining on image transfer belt 8 and the scraped toner is accumulated in image transfer belt cleaner container 12. Paper cassette 13 is detachably mounted to image forming apparatus 1 and is capable of stacking paper sheets 15 serving as a printable medium therein. Hopping roller 14 conveys paper sheets 15 from paper cassette 13 to resist rollers 16 and 17. Resist rollers 16 and 17 convey paper sheet 15 to image transfer belt 8 at the appropriate time. Fixing unit 18 fixes the toner image to the paper sheet 15 by heating and pressing the toner image. The printed paper sheet is discharged along paper sheet guide 19 to discharge tray 20 such that the printed side of the paper sheet faces downward in discharge tray 20.

Figure 4:
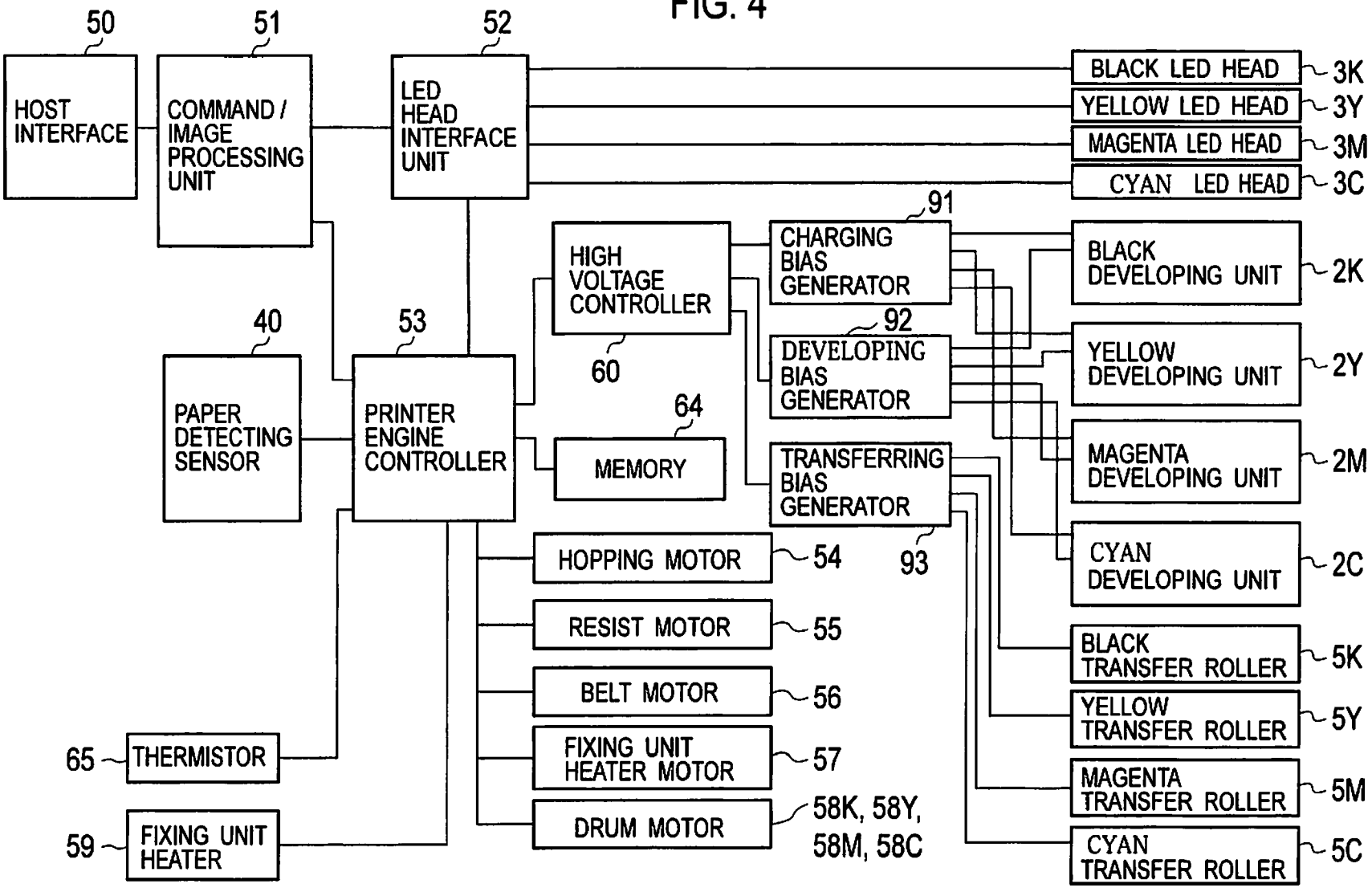
FIG. 4 is a block diagram of a configuration of a control circuit of image forming apparatus 1 of FIG. 3.

FIG. 4 is a block diagram of the configuration of the control circuit of image forming apparatus 1 of FIG. 3. The control circuit of image forming apparatus 1 includes host interface 50. Host interface 50 transmits and receives data to and from command/image processing unit 51. Command/image processing unit 51 outputs image data to LED head interface unit 52. LED head interface unit 52 is controlled by printer engine controller 53 and outputs driving pulses to turn on LED heads 3K, 3Y, 3M, 3C to emit light.

Printer engine controller 53 receives a detected signal or the like from paper detecting sensor 40 and transmits controlling values for charging bias, developing bias, image transferring bias and the like to high voltage controller 60. High voltage controller 60 transmits signals to charging bias generator 91, developing bias generator 92, and image transferring bias generator 93. Charging bias generator 91 and developing bias generator 92 apply bias voltages to charging rollers 36K, 36Y, 36M, and 36C and developing rollers 34K, 34Y, 34M, and 34C in developing units 2K, 2Y, 2M, and 2C. High voltage controller 60 and image transferring bias generator 93 comprise a transfer high voltage power supply of the first embodiment according to the invention.

Printer engine controller 53 drives hopping motor 54, resist motor 55, belt motor 56, fixing unit heater motor 57, and drum motors 58K, 58Y, 58M, and 58C at desired times. The temperature of fixing unit heater 59 is controlled by printer engine controller 53, according to a value detected by thermistor 65.

(Configuration of Transfer High Voltage Power Supply)

FIG. 1 is a block diagram showing an image forming power supply device (for example, transfer high voltage power supply) having a piezoelectric transformer-driving device according to the first embodiment of the invention.

High voltage controller 60 and image transferring bias generator 93 shown in FIG. 4 comprise transfer high voltage power supply 90. Transfer high voltage power supply 90 is provided for each of image transfer rollers 5 (5K, 5Y, 5M, and 5C). Each transfer high voltage power supply 90 has the same circuit configuration and thus the following description is for only one circuit configuration thereof.

Transfer high voltage power supply 90 inputs therein an ON/OFF signal output from output port OUT2 of printer engine controller 53, reset signal RESET output from output port OUT3 of printer engine controller 53, and target voltage V53*a* having a range of, for example, 3.3 V and output from variable voltage output circuit 53*a* (for example, digital-analog converter (DAC) 53*a* having 10-bit resolution) serving as a target voltage instructing unit, and provided in printer engine controller 53, and generates a high voltage DC (direct-current) and supplies the high voltage to load ZL, which is image transfer roller 5 in this embodiment.

Transfer high voltage power supply 90 includes piezoelectric transformer driving device 80 of the first embodiment, piezoelectric transformer 85, rectification circuit 86, output voltage conversion unit 87, output voltage comparison unit 88, and the like.

Piezoelectric transformer driving device 80 is configured to drive piezoelectric transformer 85 and includes oscillator 81, high voltage controller 60, DC power supply 83, and piezoelectric transformer driving circuit 84. Oscillator 81 is a circuit that generates a reference clock (hereinafter clock) CLK having a constant frequency (for example, 33.33 MHz). The output of oscillator 81 is connected to high voltage controller 60.

High voltage controller 60 is synchronized with clock CLK output from oscillator 81, is controlled by printer engine controller 53, and outputs piezoelectric transformer driving pulse (hereinafter "driving pulse") S60. High voltage controller 60 has clock input port CLK_IN for inputting thereto clock CLK, input port IN1 for inputting thereto comparison result S88, input port IN2 for inputting thereto ON/OFF signal output from output port OUT2 of printer engine controller 53, reset input port IN3 for inputting thereto reset signal RESET which is output from output port OUT3 of printer engine controller 53, and output port OUT1 for outputting driving pulse S60. Based on the ON/OFF signal input to high voltage controller 60, driving pulse S60 which is to be output from output port OUT1 is controlled to be on or off. Reset signal RESET inputted to high voltage controller 60 resets the setting for output from output port OUT1.

Note that, inputting reset signal RESET into reset input port IN3 can be omitted if a combination of an On signal and a Reset signal is input into input port IN2, instead of inputting the ON/OFF signal into input port IN2.

High voltage controller 60 comprises, for example, an application specific integrated circuit (hereinafter "ASIC"), which is an integrated circuit designed for a specific application including various function circuits, a microprocessor incorporating a central processing unit (hereinafter "CPU"), a field programmable gate array (hereinafter "FPGA"), which is a gate array for which the user can write logic, or the like.

Piezoelectric transformer driving circuit 84 is connected to output port OUT1 of high voltage controller 60 and DC power 83 that outputs DC 24V. Piezoelectric transformer driving circuit 84 is a circuit that outputs a driving voltage using switching elements. The output of piezoelectric transformer driving circuit 84 is connected to piezoelectric transformer 85. Piezoelectric transformer 85 is a transformer that boosts the driving voltage and outputs alternate current (hereinafter "AC") of high voltage by using the resonant oscillation of a voltage oscillator of ceramics or the like. An output of piezoelectric transformer 85 is connected to rectifier 86 (for example, a rectification circuit). Rectification circuit 86 is a circuit that converts high voltage AC output from piezoelectric transformer 85 to DC high voltage and outputs the DC high voltage to load ZL. Output voltage conversion unit 87 is connected to rectification circuit 86.

Output voltage conversion unit 87 is a circuit that converts the high voltage DC to low voltage DC. Output voltage comparison unit 88 serving as a voltage comparison unit is connected to output voltage conversion unit 87. Output voltage comparison unit 88 compares the low voltage DC output from output voltage conversion unit 87 with target voltage V53*a* output from DAC 53*a* of printer engine controller 53, and outputs this comparison result S88 into input port IN1 of high voltage controller 60.

Note that although transfer high voltage power supply 90 shown in FIG. 1 is provided for each of image transfer rollers 5 (=5K, 5Y, 5M, 5C), that is, provided for each of the channels in this embodiment, a part of transfer high voltage power supply 90 may be shared by the channels. For example, piezoelectric transformer 85, rectification circuit 86 and the like are needed for each of the channels, but oscillator 81, high voltage controller 60, and the like can be shared by the channels. In such a case where oscillator 81, high voltage controller 60 and like are shared by the channels, high voltage controller 60 is configured to have input and output ports for each of the channels. Further, although high voltage controller 60 is provided in transfer high voltage power supply 90 in this embodiment, high voltage controller 60 may be provided in a large-scale integrated circuit (hereinafter "LSI") in printer engine controller 53.

Figure 2:
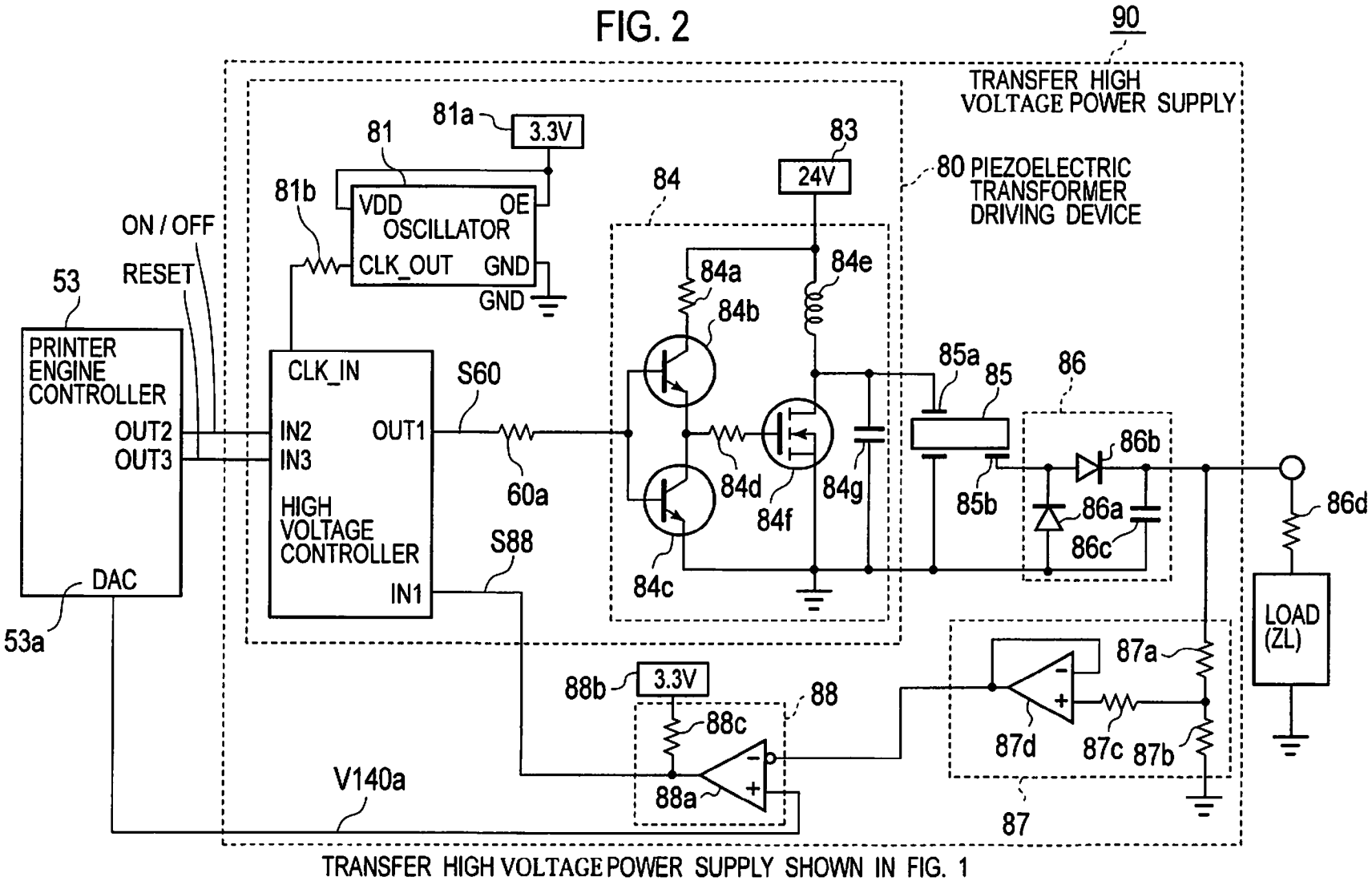
FIG. 2 is a circuit diagram showing a detail configuration of the transfer high voltage power supply 90 of FIG. 1.
Figure 5:
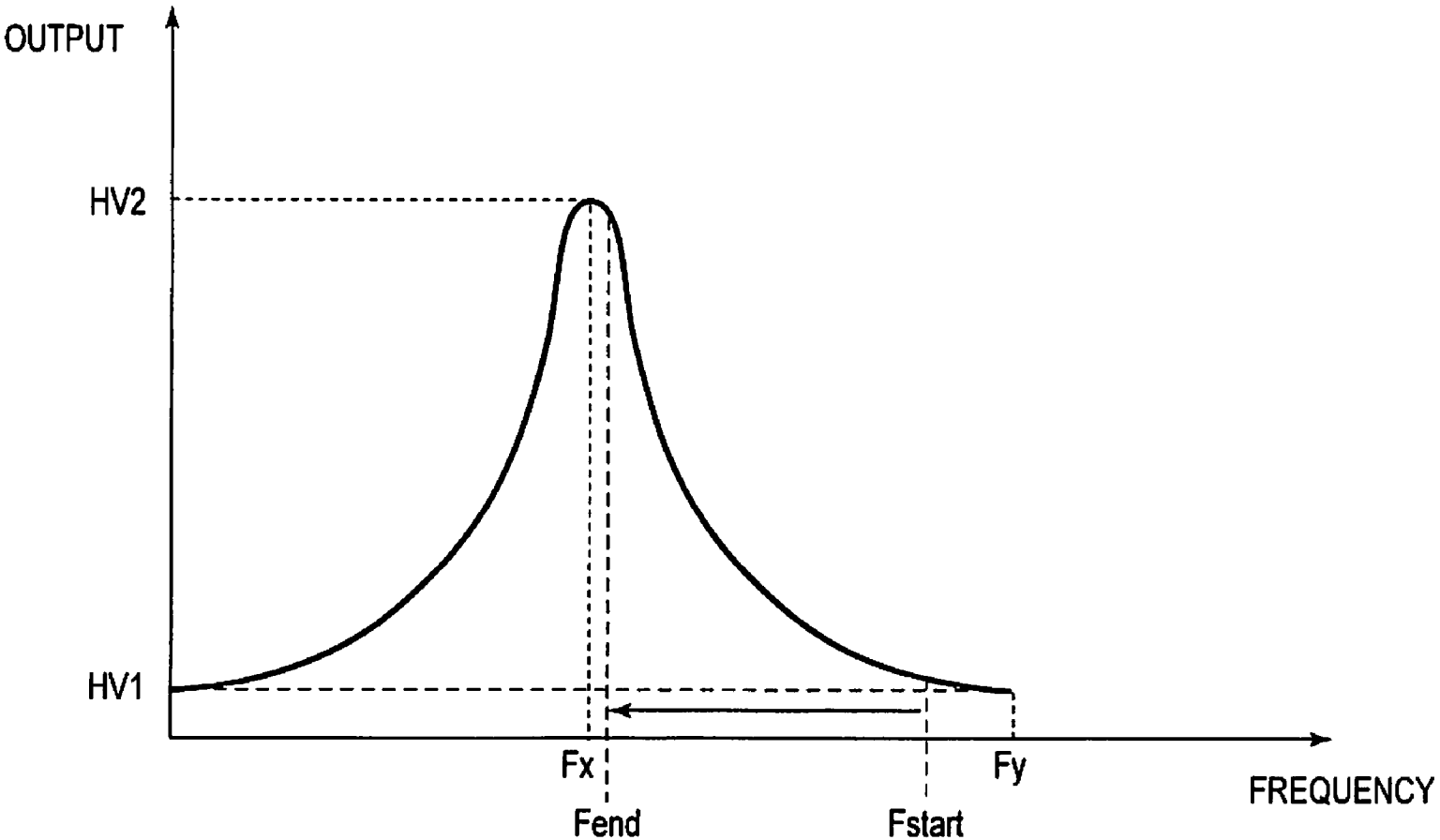
FIG. 5 is an output voltage-frequency curve of piezoelectric transformer 85 shown in FIG. 2.

FIG. 2 is a circuit diagram of a detail configuration of transfer high voltage power supply 90 shown in FIG. 1. FIG. 5 is an output voltage-frequency curve of piezoelectric transformer 85 shown in FIG. 2.

Oscillator 81 is a circuit that is energized by DC 3.3 V from power supply 81*a* and operates to generate clock signal CLK having the oscillating frequency 33.33 MHz. Oscillator 81 has power input terminal VDD to which DC 3.3 V is input, output enable terminal OE to which DC 3.3 V is input, clock output terminal CLK_OUT from which clock signal CLK is output, and ground terminal GND. Clock output terminal CLK_OUT is connected to clock input port CLK_IN of high voltage controller 60 via resistor 81*b*.

High voltage controller 60 operates in synchronization with clock signal CLK. High voltage controller 60 has output port OUT1 from which driving pulse S60 is output. Piezoelectric transformer driving circuit 84 is connected via resistor 60*a* to output port OUT1. DC power supply 83 is also connected to piezoelectric transformer driving circuit 84. DC power supply 83 supplies DC 24 V, for example, by converting and rectifying AC 100 V supplied from an un-illustrated low voltage power supply such as a commercial power supply.

Piezoelectric transformer driving circuit 84 includes resistor 84*a*, a gate drive circuit consisting of NPN transistor 84*b* and PNP transistor 84*c*, input resistor 84*d*, a resonance circuit consisting of inductor (coil) 89*e* and capacitor 84*g*, and power transistor 84*f* (for example, N channel power MOSFET (hereinafter "NMOS")) serving as a switching element. Resistor 84*a*, NPN transistor 84*b*, and PNP transistor 84*c* are series-connected between DC power supply 83 and ground GND. The bases of NPN transistor 84*b* and PNP transistor 84*c* are connected to resistor 60*a*. Inductor 84*e* and NMOS 84*f* are series-connected between DC power supply 83 and ground GND. The gate of NMOS 84*f* is connected to the collector of NPN transistor 84*b* and the emitter of PNP transistor 84*c* via input resistor 84*d*. Capacitor 84*g* is parallel connected to NMOS 84*f* such that capacitor 84*g* is connected between the drain and the source of NMOS 84*f*.

As driving pulse S60 output from high voltage controller 60 is input through resistor 60*a* to the bases of NPN transistor 84*b* and PNP transistor 84*c* forming the gate drive circuit in piezoelectric transformer driving circuit 84, driving pulse S60 is driven by NPN transistor 89*b* and PNP transistor 84*c* and input to the gate of NMOS 84*f*. Accordingly, DC 24V of DC power 83 is switched by NMOS 84*f* and is resonated by the resonance circuit composed of inductor 84*e* and capacitor 84*g*, so that the driving voltage having AC sine wave peak voltage of several tens of volts is output from piezoelectric transformer driving circuit 84.

The output of the resonance circuit is connected to input terminals 85*a* (the primary side) of piezoelectric transformer 85. Depending on a switching frequency of NMOS 84*f*, high voltage AC having 0 to tens of KV is output from output terminal 85*b* (the secondary side) of piezoelectric transformer 85. As shown in FIG. 5, the output voltage characteristic of output terminal 85*b* (the secondary side) of piezoelectric transformer 85 is dependent on frequency, that is, its voltage rising ratio varies according to the switching frequency of NMOS 84*f*.

As shown in FIG. 5, piezoelectric transformer 85 has the maximum voltage rising ratio at frequency Fx and has the minimum voltage rising ratio around frequency Fy. In the first embodiment, the frequency is controlled in a range between start frequency Fstart and frequency Fend that is higher than resonance frequency Fx.

The secondary side (output terminal 85*b*) of piezoelectric transformer 85 is connected to rectification circuit 86 for AC/DC conversion. Rectification circuit 86 converts high voltage AC output from the secondary side (output terminal 85*b*) of piezoelectric transformer 85 to high voltage DC.

Rectification circuit 86 is composed of diodes 86*a* and 86*b* and capacitor 86*c*. Output of rectification circuit 86 is connected to load ZL, which is transfer roller 5, via resistor 86*d*, and is connected to output voltage conversion unit 87.

Output voltage conversion unit 87 includes a voltage divider comprising voltage dividing resistors 87*a* and 87*b*, and a voltage follower circuit comprising operational amplifier (Op-Amp) 87*d* which inputs the low voltage therein via protective resistor 87*c*. Voltage dividing resistors 87*a* and 87*b* voltage-divide the high voltage DC of rectification circuit 86 to generate low voltage (for example, voltage equal to or lower than DC 3.3 V). Operational amplifier (Op-Amp) 87*d* inputs therein the low voltage via protective resistor 87*c*. For example, a resistance of voltage dividing resistor 87*a* is 200MΩ and a resistance of voltage dividing resistor 87*b* is 100KΩ, so that high voltage DC output from rectification circuit 86 is divided into one of 2001st (1/2001) of the inputted voltage. Voltage of 24 V is applied from DC power supply 83 to operational amplifier 87*d*, and the output of operational amplifier 87*d* serving as a voltage follower circuit is connected to output voltage comparison unit 88.

Output voltage comparison unit 88 includes comparator 88*a* serving as a voltage comparing device to which 24 V of DC power supply 83 is applied, and DC 3.3V power supply 88*b* and pull-up resistor 88*c* which pull up the output terminal of comparator 88*a*. Comparator 88*a* has a negative input terminal inputting thereto the output voltage of the voltage follower circuit, and a positive input terminal inputting thereto target voltage V53*a* output from DAC 53*a* provided in printer engine controller 53. Comparator 88*a* is a circuit that compares the voltage of the negative input terminal with the voltage of the positive input terminal and outputs comparison result S88 from the output terminal thereof. Comparison result S88 is input to input port IN1 of high voltage controller 60. The output terminal of comparator 88*a* is connected to DC 3.3 V power supply 88*b* via pull-up resistor 88*c*.

When DAC 53*a* provided in printer engine controller 53 and having the 10-bit resolution capability outputs target voltage V53*a* having, for example 3.3 V range, to the positive input terminal of comparator 88*a*, comparator 88*a* compares target voltage V53*a* with the output voltage of output voltage conversion unit 87.

When target voltage V53*a* is greater than the output voltage of output voltage conversion unit 87, the output terminal of comparator 88*a* is pulled up to DC 3.3 V (=High level, hereinafter represented by "H") by DC 3.3 V power supply 88*b* and resistor 88*c*, and such "H" is input to input port IN1 of high voltage controller 60.

On the other hand, when target voltage V53*a* is less than the output voltage of output voltage conversion unit 87, the output terminal of comparator 88*a* becomes a low level (hereinafter represented by "L") and such "L" is input to input port IN1 of high voltage controller 60.

(Configuration of High Voltage Controller in Transfer High Voltage Power Supply)

Figure 6:
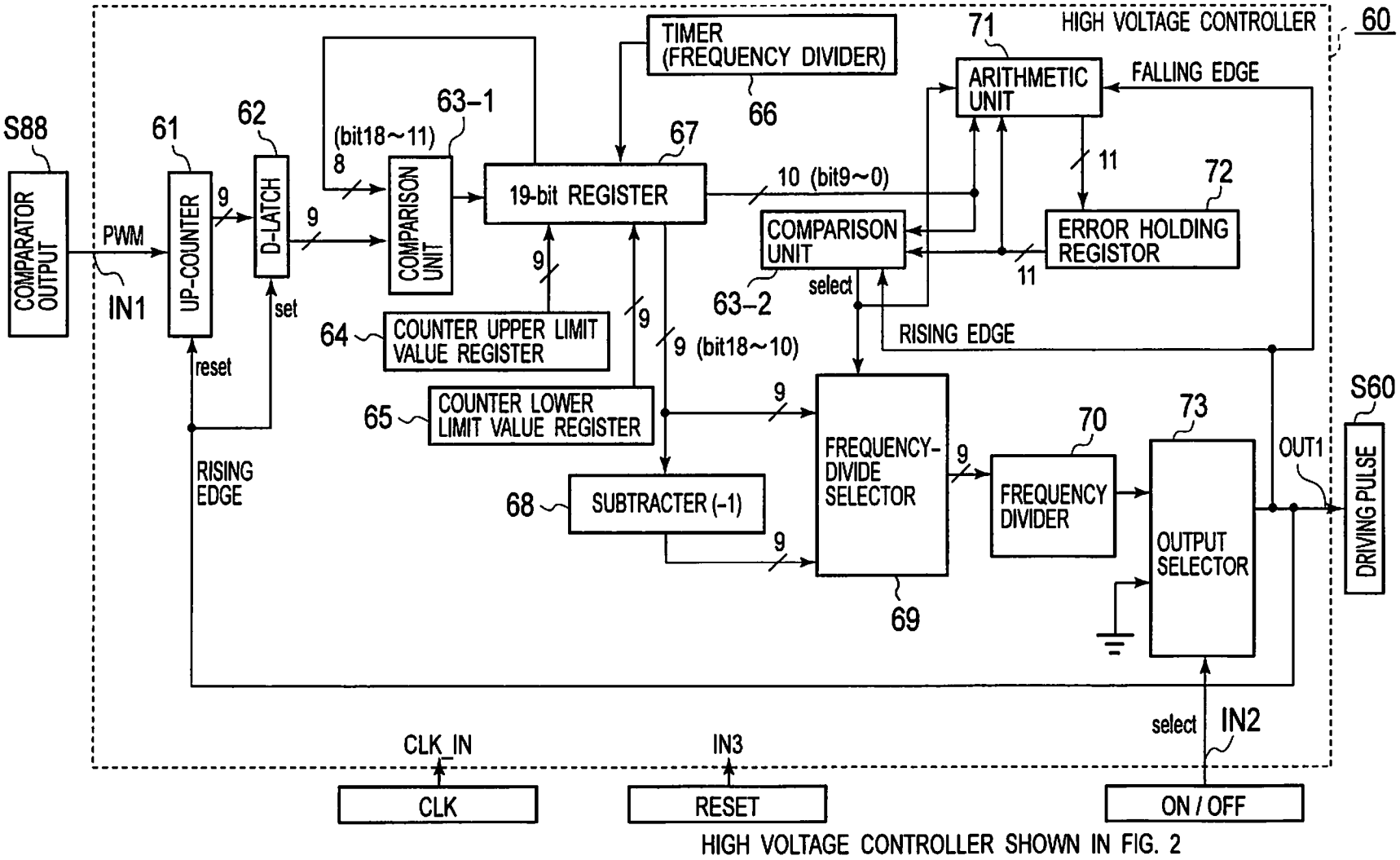
FIG. 6 is a block diagram of high voltage controller 60 shown in FIG. 2.

FIG. 6 is a block diagram of high voltage controller 60 shown in FIG. 2.

High voltage controller 60 comprises, for example, an ASIC, described in a hardware description language or the like. Clock signal CLK and reset signal RESET are to be input to high voltage controller 60. Clock signal CLK is supplied to a synchronous circuit that will be described later, and reset signal RESET is supplied to such synchronous circuit for initialization.

High voltage controller 60 has up-counter 61 to which input port IN1 is connected. Up-counter 61 is a 9-bit counter that starts when comparison result S88, which is a pulse width modulation signal (PWM) output from comparator 88*a*, is "H" as an enable signal, and counts up based on a leading edge of the pulse of clock signal CLK. Up-counter 61 does not count up while comparison result S88 is "L", and counts up only when comparison result S88 is "H". Up-counter 61 is reset to "0" by a rising edge of driving pulse S60 output from output selector 73, and is also reset to "0" when reset signal RESET supplied from printer engine controller 53 is "L". Up-counter 61 stops counting during a period when reset signal RESET is "L". The 9-bit output value of up-counter 61 is supplied to data latch (hereinafter "D-latch") 62.

D-latch 62 holds the 9-bit output value of up-counter 61 in response to an input of a rising edge of driving pulse S60 output from output selector 73 and outputs the held 9-bit value to first comparison unit 63-1. When input reset signal RESET is "L", the held 9-bit value is cleared to "0" in D-latch 62. First comparison unit 63-1 compares the held 9-bit value of D-latch 62 with an 8-bit value from bit [18] to bit [11] among bit [18] to bit [0], which is equivalent to a half of the upper 9-bit value of 19-bit register 67.

If the 9-bit value of D-latch 62 is greater than the 8-bit value from bit [18] to bit [11] of 19-bit register 67, comparison unit 63-1 outputs "H" to frequency-divide ratio-instructing unit (for example, 19-bit register) 67. If not, comparison unit 63-1 outputs "L" to 19-bit register 67. That is to say, comparison unit 63-1 counts a "H" state of comparison result S88 only during a pulse period when driving pulse S60 is output from output selector 73, and outputs "H" to 19-bit register 67 if "H" period is greater than 50% of the pulse period and outputs "L" to 19-bit register 67 if "H" period is not greater than 50% of the pulse period. Note that, upon such a comparison process in comparison unit 63-1, the 9-bit value of D-latch 62 is compared with a value of 9 bits wherein 1 bit of "0" is added to the top of the upper 8 bits of 19-bit register.

19-bit register 67 holds a frequency-divide ratio. Counter lower limit value register 65, and timer (frequency divider) 66, and counter upper limit value register 64 are connected to an input terminal of 19-bit register 67. A binarization unit (for example, subtracter (−1) 68 and frequency-divide selector 69) is connected to an output terminal of 19-bit register 67. Further, second comparison unit 63-2 and arithmetic unit 71 are connected to an output terminal of 19-bit register 67. Counter upper limit value register 64 is a 9-bit register that sets the upper limit value of the frequency-divide ratio. Counter lower limit value register 65 is a 9-bit register that sets the lower limit value of the frequency-divide ratio. Timer (frequency divider) 66 is configured to count clock signals CLK and output a pulse to 19-bit register 67 in a predetermined cycle.

In 19-bit register 67, the upper 9 bits corresponds to an integer part of the frequency-divide ratio, and the lower 10 bits corresponds to a fractional part of the frequency-divide ratio. The lower 10-bit value is equivalent to (the lower 10-bit value)/1024. The real value of the 19-bits is equivalent to (the upper 9-bit value)+(the lower 10-bit value)/1024. When reset signal RESET input to 19-bit register 67 is "L", the lower 10 bits is cleared to "0" and the 9-bit value of counter lower limit value register 65 is set in the upper 9 bits of 19-bit register 67. The upper 9 bits is output to subtractor (−1) 68 and frequency-divide selector 69. The lower 10 bits is output to comparison unit 63-2 and arithmetic unit 71. The value of 19-bit register 67 is updated at a rising edge of pulses input from timer (frequency divider) 66. In such an updating process, the register value in 19-bit register 67 is counted up when the output signal of comparison unit 63-1 is "H", and is counted down when the output signal of comparison unit 63-1 is "L". Upon counting down, when the upper 9-bit value becomes less than the counter lower limit value, the upper 9-bit value is set back to the value of counter lower limit value register 65. Upon counting up, when the upper 9-bit value becomes greater than the counter upper limit value, the upper 9-bit value is set back to the value of counter upper limit value register 64.

Subtracter (−1) 68 subtracts 1 from the 9-bit value output from 19-bit register 67, which is the integer part of the frequency-divide ratio output from 19-bit register 67, and outputs the subtracted value to frequency-divide selector 69. The output terminal of frequency-divide selector 69 is connected to output selector 73 via frequency-dividing unit (or, frequency divider) 70. An output terminal of comparison unit 63-2 is connected to arithmetic unit 71, and an input terminal of comparison unit 63-2 is connected to error holding register 72 and output selector 73. Error holding register 72 is an 11-bit register registering a signed 11-bit value wherein the upmost bit is a sign.

Comparison unit 63-2 compares the lower 10-bit value of 19-bit register 67 with the 11-bit value of error holding register 72, at a rising edge of a pulse output from output selector 73.

When the lower 10-bit value of 19-bit register is equal to "0", or the 11-bit value of error holding register 72 is less than "0", comparison unit 63-2 outputs select signal SELECT of "L" to frequency-divide selector 69.

When the lower 10-bit value of 19-bit register is not equal to "0" and the 11-bit value of error holding register is equal or greater than 0, comparison unit 63-2 outputs select signal SELECT of "H" to frequency-divide selector 69.

Frequency-divide selector 69 is a circuit that outputs the 9-bit value of subtracter (−1) 68 to frequency divider 70 when select signal SELECT output from comparison unit 63-2 is "L", and outputs to frequency divider 70 the 9-bit value output from 19-bit register 67 when select signal SELECT output from comparison unit 63-2 is "H". Arithmetic unit 71 performs calculations based on inputs of the lower 10 bits of 19-bit register 67, 11 bits of error holding register 72, and 1-bit of an output signal of comparison unit 63-2, and updates error holding register 72 based on the calculation result in 10 bits. The update process is performed at the rising edge of driving pulse S60 output from output selector 73. Arithmetic unit 71 calculates as follows.

When the output signal of comparison unit 63-2 is "H", arithmetic unit 71 calculates using the following expression and updates error holding register 72 to the calculation result.

(the lower 10-bit value of 19-bit register)+(11-bit value of error holding register)−1024

When the output signal of comparison unit 63-2 is "L", arithmetic unit 71 calculates the following expression and updates error holding register 72 to the calculation result.

(the lower 10-bit value of 19-bit register)+(11-bit value of error holding register)

Frequency divider 70 is configured to frequency-divide clock signal CLK by the frequency-divide ratio, which is the 9-bit value output from frequency-divide selector 69, and to output a pulse of the frequency-divided clock signal with the duty cycle 30% (30% ON) to output selector 73. Output selector 73 inputs thereto the ON/OFF signal as select signal SELECT, continuously outputs driving pulse S69 of "L"

when the ON/OFF signal is "L", and outputs the pulse output from frequency divider 70 as driving pulse S60 to piezoelectric transformer driving circuit 84 when the ON/OFF signal is "H".

Note that high voltage controller 60 shown in FIG. 6 is formed of an ASIC, a high voltage controller may be formed of FPGA, microprocessor module, or the like.

(General Operation of Image Forming Apparatus)

As shown in FIGS. 3 and 4, host interface 50 of image forming apparatus 1 receives print data, which is described in PDL (Page Description Language) or the like, from an unillustrated external apparatus. Command/image processing unit 51 converts the print data to bitmap data (image data) and transmits the bitmap data to LED head interface unit 52 and printer engine controller 53. Printer engine controller 53 controls heater 59 of fixing unit 18 based on a detected value of thermistor 65. After the temperature of the fuser roller in fixing unit 18 reaches to a predetermined temperature, the printing operation is started.

Then, paper sheet 15 in paper cassette 13 is fed by hopping roller 14 and is transferred to transfer belt 8 by resist rollers 16 and 17 in synchronization with an image forming operation which will be described in detail later. In developing units 2K, 2Y, 2M, and 2C, toner images are formed on photosensitive drums 32K, 32Y, 32M, and 32C, respectively, by an electrophotographic process. In such an electrophotographic process, LED heads 3K, 3M, 3Y, and 3C turn on and off to emit light based on the bitmap data, so as to form latent images on photosensitive drums 32K, 32Y, 32M, and 32C. Developing units 2K, 2Y, 2M, and 2C develop the latent images thereby forming toner images on photosensitive drums 32K, 32Y, 32M, and 32C. The developed toner images on photosensitive drums 32K, 32Y, 32M, and 32C are transferred to paper sheet 15 that is conveyed on image transfer belt 8, by high-voltage DC biases that are applied from transfer high voltage power supply 90 to image transfer rollers 5K, 5Y, 5M, and 5C. Then, paper sheet 15 having the four-color toner image thereon is transferred to fixing unit 18. Fixing unit 18 fixes the color toner image to paper sheet 15, and then the paper sheet is discharged out of the image forming apparatus.

(Operation of Transfer High Voltage Power Supply)

First, an outline of the operation of transfer high voltage power supply 90 shown in FIG. 1 will be described.

Since the color image forming apparatus has four outputs (four circuits) for transferring which have the same configuration, the first embodiment describes only one transfer high voltage power supply 90 as one of the four outputs (one circuit).

10-bit DAC 53*a* provided in printer engine controller 53 outputs target voltage V53*a* to output voltage comparison unit 88 provided in transfer high voltage power supply 90, to set DC high voltage that is to be output from transfer high voltage power supply 90. For example, in order to output DC high voltage of 5 KV, target voltage V53*a* is set to 2.5 [V]. That is, 307 hex is set in 10-bit DAC 53*a*, DAC 53*a* outputs target voltage V53*a* of 2.5 V to output voltage comparison unit 88. At this time, printer engine controller 53 sets the ON/OFF signal to be output from output port OUT2 to high voltage controller 60 to OFF ("L"), and outputs reset signal RESET from output port OUTS to high voltage controller 60, thereby resetting high voltage controller 60.

Based on the ON/OFF signal output from printer engine controller 53, high voltage controller 60 frequency-divides clock signal CLK output from oscillator 81 to form driving pulse S60 and outputs driving pulse S60 to piezoelectric transformer driving circuit 84. Printer engine controller 53 changes the frequency divide ratio, based on the status of comparison result S88 output from output voltage comparison unit 88. Piezoelectric transformer driving circuit 84 converts DC 24 [V] supplied from DC power supply 83, to form the driving voltage by the switching operation based on driving pulse S60 and outputs the driving voltage to the primary side of piezoelectric transformer 85. The primary side of piezoelectric transformer 85 is driven by this driving voltage and the secondary side of piezoelectric transformer 85 outputs high voltage AC. This high voltage AC is rectified to be high voltage DC by rectification circuit 86 and the high voltage DC is supplied to image transfer roller 5, which is load ZL shown in FIG. 2.

Output voltage conversion unit 87 converts high voltage DC output from rectification circuit 86 into, for example, 2001st of the high voltage, and outputs the converted voltage to voltage comparison unit 88. Output voltage comparison unit 88 compares target voltage V53*a* output from DAC 53*a* with the output voltage output from output voltage conversion unit 87, and supplies comparison result S88 to high voltage controller 60. When the output voltage of output voltage conversion unit 87 is lower than target voltage V53*a*, output voltage comparison unit 88 outputs an "H" signal in TTL level. When the output of output voltage conversion unit 87 is equal to or higher than target voltage V53*a*, output voltage comparison unit 88 outputs an "L" signal in TTL level.

When the output voltage of output voltage conversion unit 87 is substantially equal to target voltage V53*a*, output voltage comparison unit 88 outputs a rectangular wave substantially synchronized with driving pulse S60 output to piezoelectric transformer driving circuit 84, since target voltage V53*a* output from DAC 53*a* is substantially stable DC voltage, while the output voltage of output voltage conversion unit 87 has a ripple (AC component) which remains therein even through rectification circuit 86 rectifies the secondary side high voltage AC of piezoelectric transformer 85.

Figure 7:
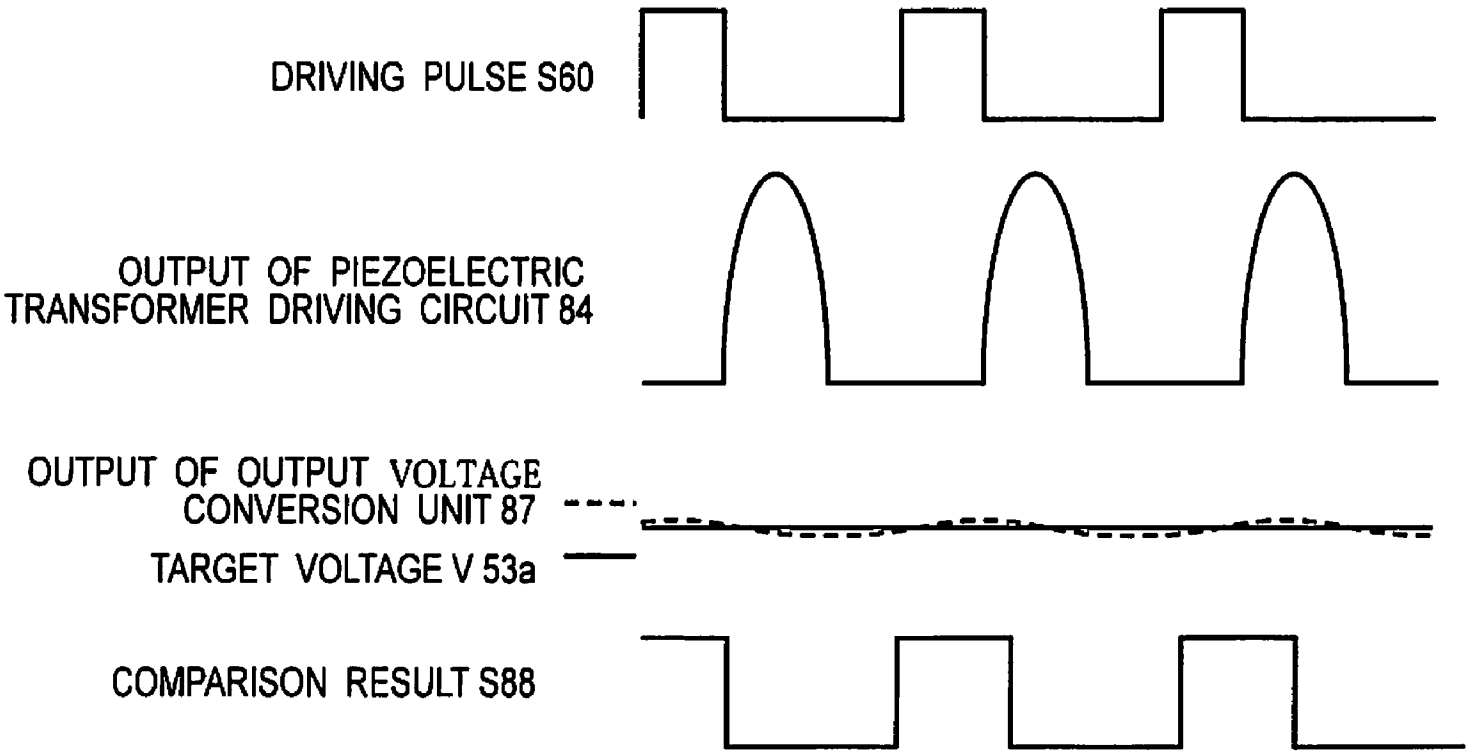
FIG. 7 is a waveform diagram showing an operation of transfer high voltage power supply 90 of FIG. 2.

FIG. 7 is a waveform diagram showing the operation of transfer high voltage power supply 90 shown in FIG. 2. Next, the detail operation of transfer high voltage power supply 90 of FIG. 2 will be described in detail with reference to FIG. 7.

Printer engine controller 53 sets reset signal RESET from output port OUT3 to "L", and resets various settings for outputs from output port OUT1 of high voltage controller 60. This reset signal is a true "L" signal. By this reset operation, values of the frequency divide ratio and etc., which are the outputs from output port OUT1, are set to default values.

DAC 53*a* of printer engine controller 53 outputs target voltage V53*a*, which is an instruction voltage for a target voltage value of a high voltage output. For example, in order to output the high voltage output of 5 KV, DAC 53*a* outputs target voltage V53*a* of 2.5 V. In this case, DAC 53*a* sets 307 hex in an internal register thereof, since DAC 53*a* has 3.3 V and 10 bits. After DAC 53*a* outputs target voltage V53*a*, reset signal RESET is changed to "H" at a predetermined time. Upon the end of the reset, high voltage controller 60 frequency-divides the default value of clock signal CLK output from clock input port CLK_IN, based on the default value of the frequency-divide ratio, a duty ratio of 30% (ON is 30%). However, during the period when the ON/OFF signal, which is output from output port OUT2 of printer engine controller 53, is "L", driving pulse S60, which is frequency-divided, is not output from output port OUT1, and "L" is kept output from output port OUT1.

Oscillator 81 is connected to clock input port CLK_IN of high voltage controller 60 through resistor 81*b*. In oscillator 81, power supply 81*a* supplies DC 3.3 V to power input terminal VDD and output enable terminal OE. Oscillator 81 outputs clock signal CLK having the oscillating frequency of 33.33 MHz and the cycle of 30 nsec from clock output terminal CLK_OUT, immediately after turning on the power.

During a period when the output of output port OUT1 is kept to "L", NPN transistor 84*b* in piezoelectric transformer driving circuit 84 is kept off and thus NMOS 84*f* is kept off while DC 24 V from DC power supply 83 is applied to the primary side input terminal 85*a* of piezoelectric transformer 85. In this state, since an electric current value of DC 24 V is almost 0 and piezoelectric transformer 85 does not oscillate, output voltage of secondary side output terminal 85*b* of piezoelectric transformer 85 is 0 V and output voltage of operational amplifier 87*d* in output voltage conversion unit 87 is "L".

In this state, regarding comparator 88*a* in output voltage comparison unit 88, 2.5 V is input to the positive terminal ("+" terminal) and "L" output from operational amplifier 87*d* is input to the negative terminal ("−" terminal). With this, the voltage of the output terminal of comparator 88*a* is DC 3.3 V, which is pulled up by power supply 88*b*, and "H" is input to input port IN1 of high voltage controller 60.

Next, printer engine controller 53 sets the ON/OFF signal output from output port OUT2 to "H" at a predetermined time, thereby turning the high voltage output into an ON state. Upon receiving the ON/OFF signal of "H" by input port IN2, high voltage controller 60 performs a frequency-division based on the default value to generate driving pulse S60 and outputs driving pulse S60 from output port OUT1. Driving pulse S60 output from output port OUT1 switches NMOS 84*f* via the gate drive circuit consisting of NPN transistor 84*b* and PNP transistor 84*c* in piezoelectric transformer driving circuit 84, and a half-wave type sine wave having tens of volts as shown in FIG. 7 is thus generated by inductor 84*c*, capacitor 84*g* and piezoelectric transformer 85, and is output to the primary side input terminal 85*a* of piezoelectric transformer 85.

With this, piezoelectric transformer 85 oscillates and outputs high voltage AC which is increased from the secondary side output terminal 85*b*. High voltage AC output from the secondary side output terminal 85*b* is rectified by rectification circuit 86 to be converted to DC voltage. DC voltage is applied to load ZL via resistor 86*d* and is voltage-divided by resistor 87*a* of 200 MΩ and resistor 87*b* of 100 KΩ in output voltage conversion unit 87. The voltage-divided DC voltage is input to the negative terminal of comparator 88*a* in output voltage comparison unit 88 through protective resistor 87*c* and operational amplifier 87*d*.

Comparator 88*a* compares target voltage V53*a*, which is input from DAC 53*a* to the positive terminal, with the DC voltage, which is input from voltage output voltage conversion unit 87 to the negative input terminal.

When target voltage V53*a* output from DAC 53*a* is larger than the DC voltage output from output voltage conversion unit 87, comparator 88*a* outputs DC 3.3 V (="H"), which is pulled up by power supply 88*b*, to input port IN1 of high voltage controller 60.

When target voltage V53*a* output from DAC 53*a* is less than the DC voltage output from output voltage conversion unit 87, comparator 88*a* outputs "L" to input port IN1 of high voltage controller 60.

When target voltage V53*a* output from DAC 53*a* is equal to the DC voltage output from output voltage conversion unit 87, comparator 88*a* outputs a rectangular wave as shown in FIG. 7 serving as comparison result S88 to input port IN1 of high voltage controller 60, since a ripple (AC component) remains in DC output voltage outputted from rectification circuit 86.

High voltage controller 60 counts the period of the input level "H" of input port IN1 during a pulse output cycle from output port OUT1 and controls the frequency-divide ratio of driving pulse S60 output from output port OUT1 so as to make the period of the "H" level 50%.

(Operation of High Voltage Controller in Transfer High Voltage Power Supply)

FIG. 8 is a table showing the relationship of the value of error holding register 72 shown in FIG. 6, the value of the lower 10 bits in 19-bit register 67, and the output signal of comparison unit 63-2.

When reset signal RESET of "L" is input to input port IN3, each counter value, up-counter 61, D-latch 62, 19-bit register 67, and error holding register 72 is initialized in high voltage controller 60 shown in FIG. 6.

When reset signal RESET is changed to be "H", an ON/OFF signal input to input port IN2 is kept at "L" which means a disable state. In a state where the high voltage output is off, comparison result S88 output from comparator 88*a* becomes "H" since DAC 53*a* outputs target voltage V53*a* of 2.5 V, and up-counter 61 thus counts up. Since there is no pulse output from output selector 73, D-latch 62 holds the "0" clear state that is set at the resetting. Comparison unit 63-1 compares an output value of D-latch 62 with the 8-bit value, which is the half value of the integer part of the frequency-divide ratio of the default value set in 19-bit register 67. Since the output value of D-latch 62 is 0, comparison unit 63-1 outputs "L" to 19-bit register 67.

Counter upper limit value register 64 is a 9-bit register configured to store therein the upper limit value of the integer part of the frequency-divide ratio, which is 302 dec (=12 E hex). Although the 9-bit upper limit value is a fixed value in this first embodiment, the 9-bit upper limit value may be rewritable or may be set from the outside. The stored limit value in counter upper limit value register 64 is continuously output to 19-bit register 67.

Counter lower limit value register 65 is a 9-bit register storing therein the default value of the integer part of the frequency-divide ratio serving as an initial frequency-divide ratio, which is 290 dec (=122 hex). Although the 9-bit default value is a fixed value in this first embodiment, the value may be rewritable or may be set from the outside. The stored default value is continuously output to 19-bit register 67.

Upon resetting, the fractional part, which is the lower 10 bits in 19-bit register 67, is cleared to be "0", and the integer part, which is the upper 10 bits in 19-bit register 67, is set to the default value of counter lower limit value register 65. 19-bit register 67 outputs a value of 8 bits from bit [18] to bit [10], which is equivalent to half of the value of the upper 9 bits, to comparison unit 63-1. 19-bit register 67 also outputs the integer part, which is the upper 9 bits of the frequency-divide ratio in 19-bit register 67, to frequency-divide selector 69 and subtracter (−1) 68. Further, the fractional part, which is the lower 10 bits in 19-bit register 67, is output to comparison unit 63-2 and arithmetic unit 71.

Since comparison unit 63-1 outputs "L" at the leading edge of the pulse input from timer (frequency divider) 66, subtraction is performed in 19-bit register 67. The value in 19-bit register 67, which is set to 48800 hex at a default state, is subtracted by 1 to become 487 Ff hex. When the subtraction is performed in 19-bit register 67, an upper 9-bit value of the subtracted value is compared with the 9-bit value in counter lower limit value register 65. Since the value of the upper 9-bit is 121 hex and the 9-bit value in counter lower limit value register 65 is 122 hex, the upper 9 bits of 19-bit register 67 is set to the 9-bit value of counter lower limit value register 65 and the lower 10 bits of 19-bit register 67 is cleared to "0". That is, the 19-bit value in 19-bit register 67 is maintained to be the default value.

Timer (frequency divider) 66 outputs a pulse to 19-bit register 67 in a predetermined cycle. The cycle is set by counting clock signal CLK by a predetermined counter value. The cycle is, for example, tens μ seconds to several hundreds of μ seconds. In modifications, the cycle may be changed depending on target voltage V53*a*, or may be arbitrarily set from the outside.

Comparison unit 63-2 outputs "L" to frequency-divide selector 69, since the lower 10 bits output from 19-bit register 67 is "0". 11 bits output from arithmetic unit 71 and 11 bits output from error holding register 72 are maintained at "0" which were set at the resetting. Subtracter (−1) 68 subtracts 1 from 290 dec (=122 hex) which is the upper 9-bit value of 19-bit register 67, and outputs 289 dec (=121 hex), which is the subtracted value, to frequency-divide selector 69.

Since select signal SELECT input from comparison unit 63-2 is "L", frequency-divide selector 69 outputs 289 dec (=121 hex), which is 9-bit value input from subtracter (−1) 68, to frequency divider 70. Frequency divider 70 counts clock signal CLK and outputs a pulse having 289×30/1000 (=8.67) μ second cycle to output selector 73, based on 289 (=121 hex) which is the value output from frequency-divide selector 69. The pulse has the high-level state (on-state) of 84×30/1000μ seconds (=2.52μ seconds) for about 30% duty, wherein 84 dec (=054 hex) is the sum of 048 hex, which is one fourth of 121 hex or a value made by 2-bit rightward shifting the 9 bits (121 hex), 008 hex, which is one thirty second of 121 hex or a value made by 5-bit rightward shifting the 9 bits (121 hex), and 004 hex, which is one sixty fourth of 121 hex or a value made by 6-bit rightward shifting the 9 bits (121 hex).

While the ON/OFF signal is "L", output selector 73 outputs driving pulse S60 of "L" to output port OUT1 to keep output port OUT1 "L".

As described above, after the reset operation, output port OUT1 is held to "L" if the ON/OFF signal is "L". However, frequency divider 70 keeps generating a pulse of the default frequency-divide ratio.

When the ON/OFF signal output from printer engine controller 53 is switched to "H", output selector 73 selects the pulse output from frequency divider 70 and outputs the selected pulse as output driving pulse S60 to output port OUT1. As a result, piezoelectric transformer driving circuit 84 shown in FIG. 2 drives piezoelectric transformer 85, thereby outputting a high voltage AC output from the secondary side output terminal 85*b*. Rectification circuit 86 rectifies the high voltage AC output to make a high voltage DC, and output voltage conversion unit 87 converts the high voltage DC to a DC low voltage and outputs the DC low voltage to output comparator 88*a* in voltage comparison unit 88.

In driving based on the default frequency-divide ratio, since the high voltage output is adequately lower than target voltage V53*a*, comparison result S88 output from comparator 88*a* is pulled up by power supply 88*b* and held to "H".

Up-counter 61 is reset by a rising edge (RESET) of the pulse output from output selector 73 and counts up at a rising edge of pulse clock signal CLK if comparison result S88 output from comparator 88*a* is "H". In an initial state, since pulses that are output from output selector 73 and are frequency-divided by 289 in the pulse cycle are all "H", up-counter 61 is reset at each count-up from 0 to 289 dec (=121 hex). D-latch 62 latches the date at the same time as the resetting, D-latch 62 thus holds this 9-bit value (121 hex). Comparison unit 63-1 receives and compares the 9-bit value of D-latch 62 and the upper 8-bit value (91 hex) of 19-bit register 67. Since the 9-bit value of D-latch 62 (121 hex) is lager than the upper 8-bit value of 19-bit register 67 (91 hex), comparison unit 63-1 outputs "H" to 19-bit register 67.

19-bit register 67 receives "H" from comparison unit 63-1 and thus counts up each leading edge of the signal from timer (frequency divider) 66. On counting-up by 19-bit register 67, 19-bit register 67 compares the 9-bit value updated by the counting-up with 9-bit value in counter upper limit value register 64. When the 9-bits in 19-bit register 67 is larger than the 9-bits in counter upper limit value register 64, the 9-bit value of counter upper limit value register 64 is set to the 9-bit value in 19-bit register 67 and the lower 10-bits in 19-bit register 67 is set to 3 Ff hex.

As described above, when the high voltage output is lower than target voltage V53*a*, comparison result S88 output from comparator 88*a* is "H" state. If "H" state is longer than 50% of the period when output selector 73 outputs the pulse, the value of 19-bit register 67, which sets the frequency-divide ratio, is increased. The frequency-divide ratio is increased by 1 every 1024-times 19-bit register 67 counts up.

Comparison unit 63-2 compares the lower 10-bit value in 19-bit register 67, which is the fractional part, with signed 11-bit value in error holding register 72 and outputs to frequency-divide selector 69 select signal SELECT to select a frequency-dividing by "N" or "N-1". When the lower 10 bits of 19-bit register 67 is 0, comparison unit 63-2 outputs "L" to frequency-divide selector 69. For example, assuming that the upper 9-bit value of 19-bit register 67 is 295 dec (=127 hex), if the lower 10 bits is 0, comparison unit 63-2 outputs "L" so that output selector 69 outputs the driving pulse S60 that is frequency divided by 294. At this time, arithmetic unit 71 updates the value of error holding register 72 to 0, since the value of error holding register 72 is 0, the lower 10-bit value of 19-bit register 67 is 0, and the output signal of comparison unit 63-2 is "L".

For example, assuming that the value of 19-bit register 67 is 49 D2 C hex wherein the upper 9-bits which is the integer part is 295 dec (=127 hex) and the lower 10-bits which is the fractional part is 300 dec (=12 C hex), since the lower 10-bit value of 19-bit register 67 is not 0, the output signal of comparison unit 63-2 is determined based on whether the output signal of error holding register 72 is plus or minus as shown in the table of FIG. 8. When the value of error holding register 72 is 0 as shown in the first line in the table of FIG. 8, the output signal of comparison unit 63-2 is 1 ("H") and thereby outputting the driving pulse S60 that is frequency-divided by 295. Since the output signal of comparison unit 63-2 is 1 at the first line in the table of FIG. 8, at the next driving pulse S60 as shown in the second line in the table of FIG. 8, error holding register 72 is updated to −724 (=52 C hex/11-bits) which is sum of −1024 and 300 which is the value of 19-bit register 67. Since the value of error holding register 72 is minus, the output signal of comparison unit 63-2 is 0 ("L") and thereby outputting the driving pulse that is frequency-divided by 294. That is, error holding register 72 always holds a difference between the fractional part of the frequency-divide ratio and the real frequency-divide ratio. Therefore, the average frequency-divide ratio over time is almost the following value.

(the upper 9-bit value of 19-bit register)+(the lower 10-bit value of 19-bit register)/1024

Even though 19-bit register 67 is updated, the value of error holding register 72 holds the previous error value. Accordingly frequency-divide selector 69 selects the frequency-divide ratio by comparing signed 11-bit value of error holding register 72 with the lower 10-bits of 19-bit register updated.

When the high voltage output exceeds target voltage V53*a*, an output signal of comparison unit 63-1 is reversed and 19-bit register 67 counts down. Eventually, the high voltage output come to equals target voltage V53*a*, the output signal of comparison unit 63-1 takes "H" and "L" in turn. That is, the lower 10-bit value of 19-bit register goes up and down repeatedly, but the resolution capability is 30/1024 nsec in average and the high voltage output thus has a stable constant voltage.

Note that although the first embodiment switches between N frequency-division that divides clock signal CLK of 33.33 MHz by N and N-1 frequency-division that divides clock signal CLK of 33.33 MHz by N-1, but a modification of the first embodiment can switch between 2N frequency-division that divides clock signal CLK of 66.66 MHz by 2N and 2N-2 frequency-division that divides clock signal CLK of 66.66 MHz by 2N-2 by using the same operation. Although the first embodiment uses clock CLK having 33.33 MHz, a lower frequency (for example, 20 MHz) than 33.33 MHz can be used if a frequency-divide ratio different from the first embodiment is applied.

When the ON/OFF signal output from printer engine controller 53 is changed to be "L", output selector 73 stops output driving pulse S60 immediately so that the high voltage output from piezoelectric transformer 85 attenuates immediately.

(Effect of First Embodiment)

According to the first embodiment, piezoelectric transformer driving device 80 binarizes the driving frequency of piezoelectric transformer 85 into two different frequencies by binarizing the frequency-divide ratio in the way that minimizes the error in the binarization. This enables stable driving of piezoelectric transformer 85 and reduces effects due to the variation by using the digital circuit compared to analog circuits and achieves them by using low frequency clocks.

[Second Embodiment]

(Configuration of Second Embodiment)

The second embodiment of the invention has the same configuration of image forming apparatus 1 shown in FIG. 3, the control circuit shown in FIG. 4, transfer high voltage power supply 90 shown in FIG. 1, and piezoelectric transformer driving device 80 shown in FIG. 2 as the first embodiment, and has a high voltage controller that has a different configuration from the first embodiment in piezoelectric transformer driving device 80.

Figure 9:
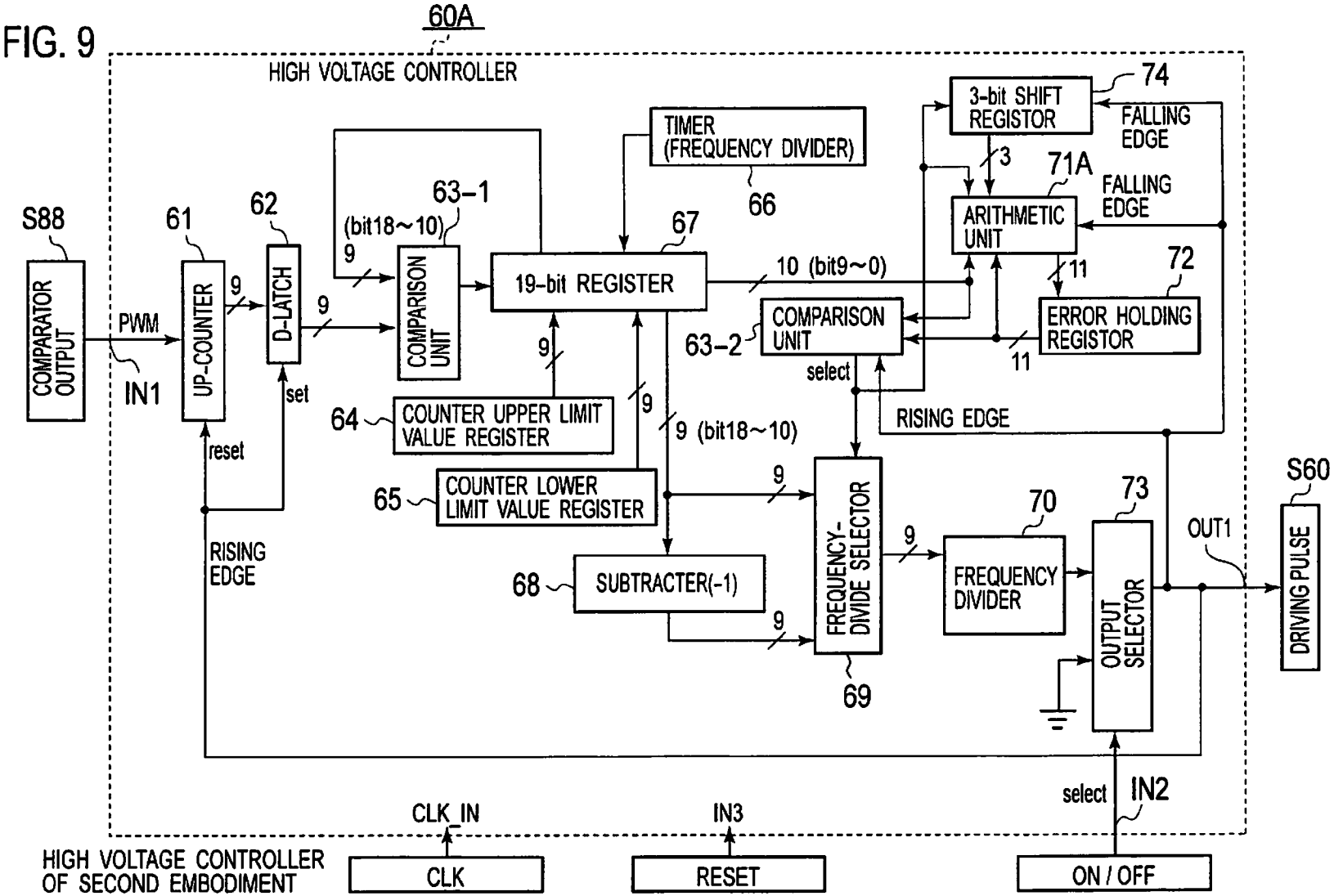
FIG. 9 is block diagram of a high voltage controller in a piezoelectric transformer-driving device according to a second embodiment of the invention.

FIG. 9 is a block diagram of a high voltage controller in a piezoelectric transformer driving device according to the second embodiment of the invention. In FIG. 9, the same configurations as those shown in FIG. 6 of the first embodiment are designated by the same reference numerals.

High voltage controller 60A of the second embodiment has 3-bit shift register 74 and arithmetic unit 71A having a different configuration or function from arithmetic unit 71 provided in high voltage controller 60 of the first embodiment.

Arithmetic unit 71A is connected to comparison unit 63-2, 19-bit register 67, error holding register 72, 3-bit shift register 74, etc. Arithmetic unit 71A performs computing, at each rising edge of driving pulse S60 output from output selector 73, based on values of the lower 10-bits of 19-bit register 67, the 11-bits of error holding register 72, 3-bit shift register 74, and select signal SELECT of comparison unit 63-2, and then updates values of error holding register 72. 3-bit shift register 74 inputs therein select signal SELECT which is output from comparison unit 63-2 to frequency-divide selector 69. 3-bit shift register 74 shifts (=sorts) the order of the bits held in 3-bit shift register 74 at each falling edge of driving pulse S60 that is output from output selector 73 and holds the shifted value.

(Operation of Second Embodiment)

In the second embodiment, general operation of image forming apparatus 1 is the same as that of the first embodiment. The following description is for an internal operation of high voltage controller 60A shown in FIG. 9 which is different from the first embodiment.

According to high voltage controller 60A, 3-bit shift register 74 initializes the internal 3 bits to 000*b* (=0 dec), when input reset signal RESET is "L". After that, at each rising edge of driving pulse S60 output from output selector 73, 3-bit shift register 74 shifts the order of the previous 3 bits rightward, deletes the previous lowest bit (=bit [0]), and updates the previous upmost bit (=bit [2]) such that the previous upmost bit (=bit [2]) is updated to "1" if reset signal RESET is "H" and is updated to "0" if reset signal RESET is "L". For example, assuming that the output signal of comparison unit 63-2 are "H", "L", "H", "L" in turn at outputs of driving pulse S60, 3-bit shift register 74, at the first output of driving pulse, shifts the previous upmost bit (=bit [2]) to the second upmost bit (=bit [1]) as new second upmost bit, shifts the previous second upmost bit (=bit [1]) to the last bit (=bit [0]) as the new last bit, deletes the previous last bit (=bit [0]), and inputs "1" to the upmost bit (=bit [2]) as the new upmost bit since the output signal of comparison unit 63-2 is "H". As the result of the first output of driving pulse S60, the value of 3-bit shift register 74 becomes 100*b*. Receiving the second output of driving pulse S60, 3-bit shift register 74 performs the same operation thereby obtaining 010*b* as a new value of 3-bit shift register 74. After that, values of 3-bit shift register 74 are changed to 101*b*, 010*b*, and so on in order. With such operation, 3-bit shift register 74 always registers the last three output signals of comparison unit 63-2 which indicates selection results of frequency-divide selector 69.

FIG. 10 is a table showing operation of arithmetic unit 71A shown in FIG. 9.

Error holding register 72 holds an error holding register value shown in the following formula, and the output signal of comparison unit 63-2 is determined based on whether the value of error holding register 72 is a positive value including 0 (=equal to or more than 0) or a negative value (=less than 0). Operations of other circuit components in response to the output signal of comparison unit 63-2 are the same as the first embodiment.

Error holding register value=(the previous lower 10-bit value of 19-bit register)−(448×previous output value of comparison unit 63-2)−(20×previous value of bit [2] of 3-bit shift register)−(192×previous value of bit [1] of 3-bit shift register)−(64×previous value of bit [0] of 3-bit shift register)+(previous error holding register value)

Error holding register 72 updates the internal value according to the above formula. The respective terms in error holding register have values (=factors) of 448, 320, 192, and 64, respectively. The values of 448, 320, 192 and 64 serve as factors to diffuse the error into 4 cycles, and are 1024 in total and its ratio are 7:5:3:1.

Note that, although the second embodiment diffuses the value into 4 cycles with its ratio of 7:5:3:1 as an example, the number of diffusion cycles, the diffusion ratio, and the like are not limited in the invention.

As described above, the second embodiment performs an algorithm different from the first embodiment to process an error in the binarization process (two values generating process), but the other processes of the second embodiment are the same as the first embodiment.

(Effect of Second Embodiment)

High voltage controller 60A of the second embodiment disperses the errors into cycles in the binarization process so as to diffuse the errors, thereby lowering a cycle number variation to the convergence of the average frequency due to variation of the fractional part of the frequency-divide ratio instruction value (the frequency instruction value). Therefore, this embodiment can obtain stable output, even though the frequency-divide ratio instruction value (the frequency instruction value) is changed due to load changes or the like.

[Third Embodiment]

(Configuration of Third Embodiment)

A third embodiment of the invention has the same configurations of image forming apparatus 1 shown in FIG. 3, the control circuit shown in FIG. 4, transfer high voltage power supply 90 shown in FIG. 1, and piezoelectric transformer driving device 80 shown in FIG. 2 as those of the first embodiment, and has a different configuration of high voltage controller in piezoelectric transformer driving device 80 from that of the first embodiment.

Figure 11:
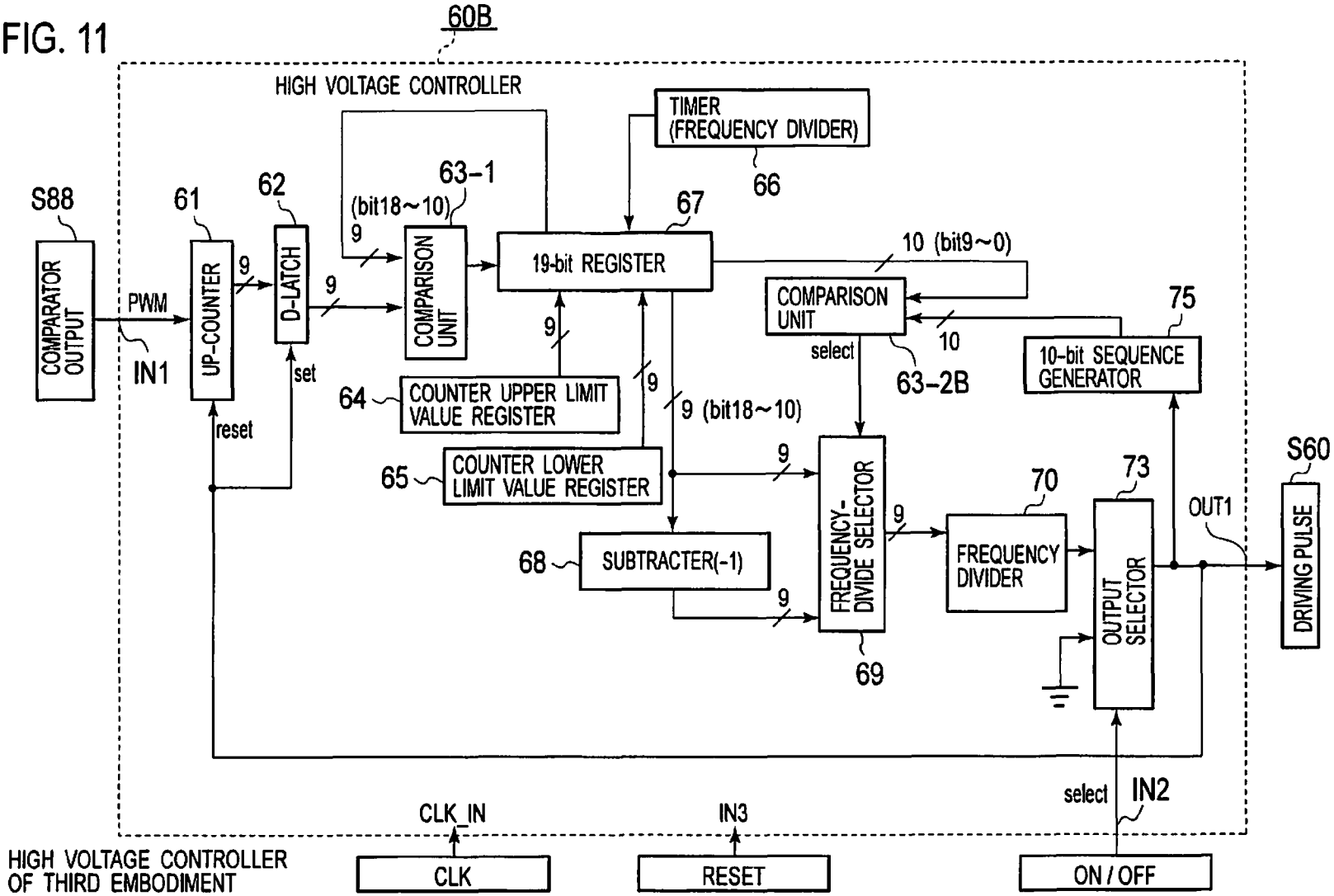
FIG. 11 is a block diagram of a high voltage controller of a piezoelectric transformer-driving device according to a third embodiment of the invention.

FIG. 11 is block diagram of a high voltage controller provided in a piezoelectric transformer driving device according to the third embodiment of the invention. In the third embodiment, the same configurations as in FIG. 6 of the first embodiment are designated by the same reference numerals.

High voltage controller 60B of the third embodiment has, instead of comparison unit 63-2, arithmetic unit 71 and error holding register 72 which are provided in high voltage controller 60 of the first embodiment, comparison unit 63-2B and 10-bit sequence generator 75 which have different configuration or function from the first embodiment.

Comparison unit 63-2B is connected to 10-bit register 67, frequency-divide selector 69, and 10-bit sequence generator 75. Comparison unit 63-2B compares the lower 10 bits output from 19-bit register 67, which is the fractional part of 19-bit register 67 with the lower 10 bits output from 10-bit sequence generator 75. Based on the comparison result, comparison unit 63-2B outputs select signal SELECT having 1-bit to frequency-divide selector 69. Each of the 10-bit values is treated as an unsigned integer (non-negative integer).

When the lower 10-bit value of 19-bit register 67 is larger than the output value from 10-bit sequence generator 75, comparison unit 63-2B outputs select signal SELECT of "H" to frequency-divide selector 69. With receiving "H", frequency-divide selector 69 outputs the upper 9-bit value of 19-bit register 67 to frequency divider 70.

On the other hand, when the lower 10-bit value of 19-bit register 67 is equal to or smaller than the output value from 10-bit sequence generator 75, comparison unit 63-2B outputs select signal SELECT of "L" to frequency-divide selector 69. With receiving "L", frequency-divide selector 69 outputs 9-bit value of subtracter (−1) 68 to frequency divider 70.

10-bit sequence generator 75 has therein a counter configured to count a rising edge of driving pulse S60 output from output selector 73, and reverses the order of bit [0] to bit [9] in the internal counter and outputs the reversed 10 bits to comparison unit 63-2B. That is to say, the following equation is satisfied if bits [9]_O to [0]_O represent bits [9] to [0] that are output form 10-bit sequence generator 75 and bits [9]_C to [0]_C represent bits [9] to [0] that are held in the internal counter in 10-bit sequence generator 75.

bit [9]__0=bit [0]_C, bit [8]__0=bit [1]_C, bit [7]__0=bit [2]_C, bit [6]__0=bit [3]_C, bit [5]__0=bit [4]_C, bit [4]__0=bit [5]_C, bit [3]__0=bit [6]_C, bit [2]__0=bit [7]_C, bit [1]__0=bit [8]_C, bit [0]__0=bit [9]_C Other configurations are the same as those of the first embodiment.

(Operation of Third Embodiment)

In the third embodiment, the general operation of image forming apparatus 1 is the same as in the first embodiment. In the third embodiment, the following description is for the internal operation of high voltage controller 60B shown in FIG. 11 which is different from the first embodiment.

In high voltage controller 60B, the lower 10 bits set in 19-bit register 67 is output to comparison unit 63-2B, and 10 bits in 10-bit sequence generator 75 is output to comparison unit 63-2B. Comparison unit 63-28 compares the lower 10 bits from 19-bit register 67 with 10 bits from 10-bit sequence generator 75. Comparison unit 63-2B outputs, if the lower 10-bit value from 19-bit register 67 is larger than 10-bit value from 10-bit sequence generator 75, select signal SELECT of "H" to frequency-divide selector 69. In this case, the comparison result between 10-bit values is treated as unsigned integer.

For example, assuming that the upper 9-bit value of 19-bit register 67 is 295 dec, the lower 10-bit value is 512 dec (=10__0000__0000 b), and the internal counter of 10-bit sequence generator 75 takes 0, 1, 2, 3, and 4 (=00__0000__0000, 00__0000__0001, 00__0000__0010, 00__0000__0011, and 00__0000__0100) in order, the output value of 10-bit sequence generator 75 whose order is reversed from that of the lower 10 bits will be 0, 512, 256, 768, and 128 (=00__0000__0000, 10__0000__0000, 01__0000__0000, 11__0000__0000, and 00__1000__0000). Accordingly, comparison unit 63-28 outputs 1, 0, 1, 0, and 1 in series, based on the comparison result. Frequency-divide selector 69 thus outputs values of 295, 294, 295, 294, and 295 in series. That is, if the value of the internal counter of 10-bit sequence generator 75 increase from 0 to 1023 in series, frequency-divide selector 69 outputs in total 295 512-times and 294 512-times, respectively. As a result, the average frequency-divide ratio is 294.5. On the other hand, in 19-bit register 67 serving as a frequency-divide ratio instructing unit, the integer part is 295, the fractional part is 512. Therefore, the fractional part, which is 512/1024 (=0.5), equals to the fractional part of the average frequency-divide ratio.

(Modification of Third Embodiment)

The third embodiment can be modified to the following examples (a), (b), or the like.

(a) The third embodiment is realized by reversing the order of the 10 bits of the internal counter. However, if the resolution capability is low, for example, around 5 bits, the value in the internal counter may be used without reversing the order of the bits of the internal counter, or a table may be used without the counter.

(b) For target voltage V53*a* to set a real-valued frequency-divide ratio, a modification (b) controls to binarize the real-valued set frequency-divide ratio by using a threshold such that the average of the binarized frequency-divide ratios equals the real-valued set frequency-divide ratio.

Note that, although the above description in the third embodiment is for a case where the value of 19-bit register 67 is not varied, it should be understood that even though the value of 19-bit register 67 is varied depending on the output value of comparison unit 63-1, the average frequency-divide ratio per unit time equals a value that is subtracted 1 from the average value of 19-bit register per unit time.

(Effect of Third Embodiment)

The third embodiment has a structure in which the frequency-divide ratio is binarized using a threshold matrix.

The embodiment thus obtains an adequate resolution capability for the high voltage output even at a low clock frequency of, for example, tens MHz, thereby facilitating a control of the digital circuit which is not affected by variations in components.

[Fourth Embodiment]

(Configuration of the Fourth Embodiment)

The fourth embodiment of the invention has the same configurations as image forming apparatus 1 shown in FIG. 3, the control circuit shown in FIG. 4, transfer high voltage power supply 90 shown in FIG. 1, and piezoelectric transformer driving device 80 shown in FIG. 2, which are the same as in the third embodiment. The fourth embodiment has a high voltage controller of piezoelectric transformer driving device 80 that has a different configuration from the third embodiment.

Figure 12:
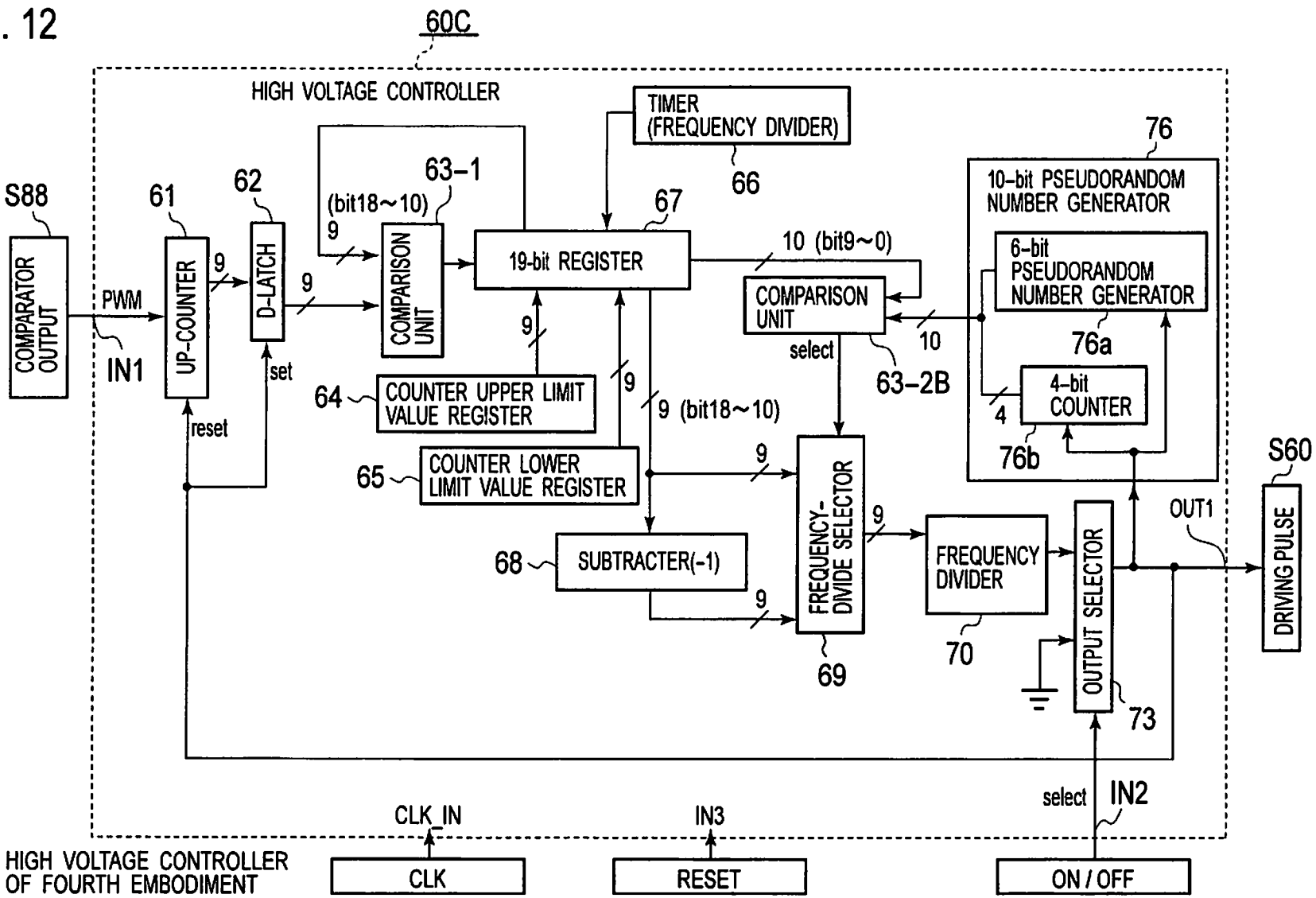
FIG. 12 is a block diagram of a high voltage controller in a piezoelectric transformer-driving device according to a fourth embodiment of the invention.

FIG. 12 is a block diagram of the high voltage controller provided in piezoelectric transformer driving device 80 according to the fourth embodiment of the invention. In the fourth embodiment, the same configurations as in FIG. 11 of the third embodiment are designated by the same reference numerals.

High voltage controller 60C of the fourth embodiment has, instead of the 10-bit sequence generator 75 provided in high voltage controller 60B of the third embodiment, 10-bit pseudorandom number generator 76 which has a different configuration from the 10-bit sequence generator 75.

10-bit pseudorandom number generator 76 is connected to comparison unit 63-2B and output selector 73 and has 6-bit pseudorandom number generator 76*a* and 4-bit counter 76*b* therein. 6-bit pseudorandom number generator 76*a* and 4-bit counter 76*b* perform a shift and a counting-up, respectively, based on a rising pulse of driving pulse S60 output from output selector 73.

6 bits output from 6-bit pseudorandom number generator 76*a* will be the lower 6 bits of 10-bit pseudorandom number generator 76. The reversed 4 bits whose order is reversed from the 4 bits of counter 76*b* is output from the counter 76*b* and will be the upper 4 bits of 10 bit pseudorandom number generator 76. That is to say, bit [3] in 4-bit counter 76*b* will be bit [9] in 10-bit pseudorandom number generator 76, bit [2] in 4-bit counter 76*b* will be bit [8] in 10-bit pseudorandom number generator 76, bit [1] in 4-bit counter 76*b* will be bit [8] in 10-bit pseudorandom number generator 76, and bit [0] in 4-bit counter 76*b* will be bit [7] in 10-bit pseudorandom number generator 76.

Figure 13:
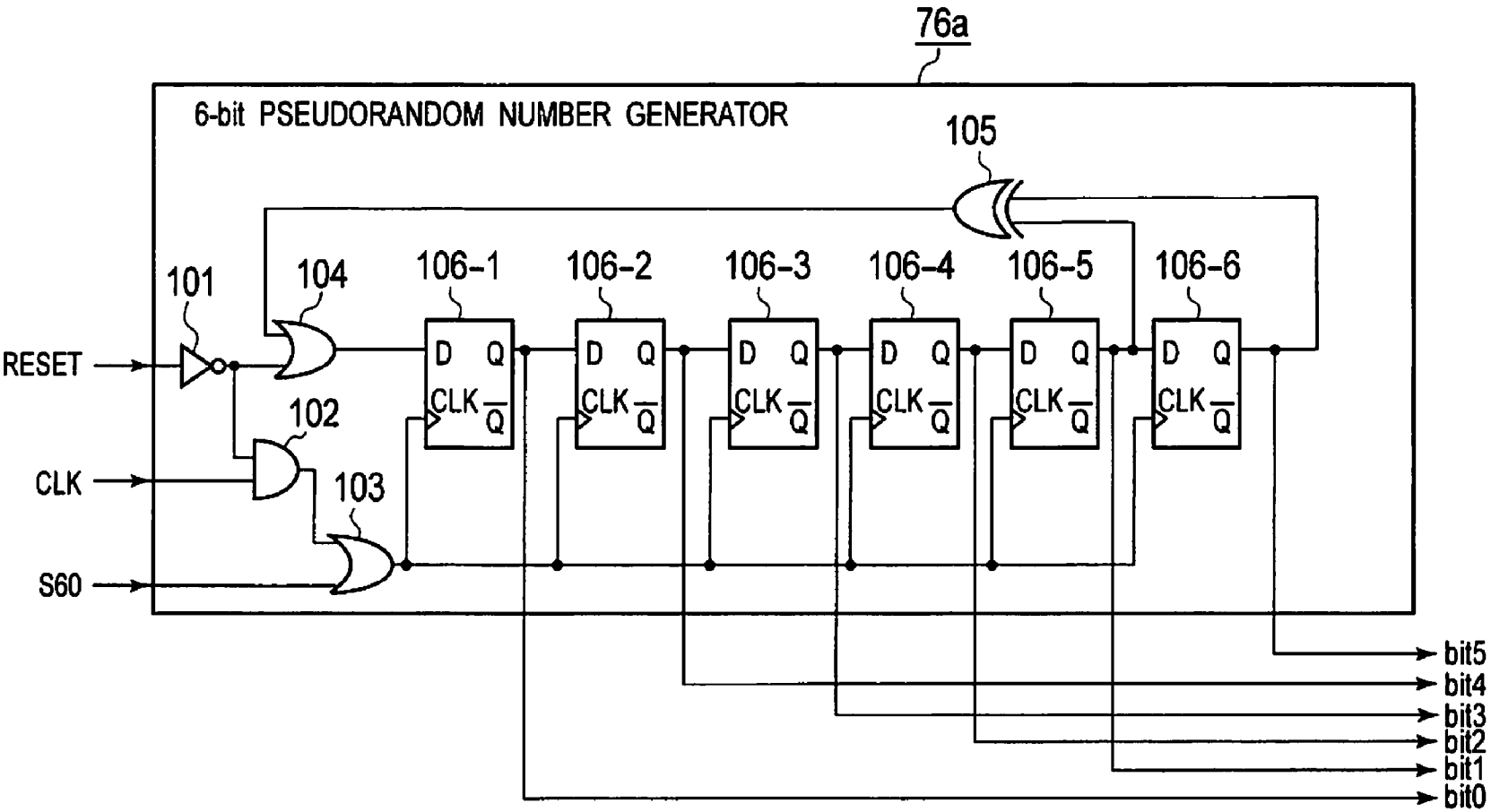
FIG. 13 is a circuit diagram of 6-bit pseudorandom number generator 76*a* shown in FIG. 12.

FIG. 13 is a circuit diagram of 6-bit pseudorandom number generator 76*a* shown in FIG. 12. 6-bit pseudorandom number generator 76*a* comprises Linear Feedback Shift Register (hereinafter, "LFSR") including inverter 101 configured to reverse reset signal RESET, 2-input AND gate 102 configured to input therein an output signal of inverter 101 and clock signal CLK and implement AND operation (hereinafter "AND"), OR gate 103 configured to input therein an output signal of AND gate 102 and an output signal of driving pulse S60 and implement logical add (hereinafter, "OR"), 2-input OR gate 104 connected to an output terminal of inverter 101, 2-input XOR gate (hereinafter, "XOR") 105 connected to an input terminal of OR gate 104, and multi-series (six series, in this example) of flip flop circuits (hereinafter, "FF") 106-1 to 106-6 connected in series to output terminals of OR gates 103 and 104. LFSR is a shift register whose input bit is a linear function of its previous state.

(Operation of Fourth Embodiment)

The general operation of image forming apparatus 1 in the fourth embodiment is the same as in the third embodiment, and thus the following explanation will be made for internal operation in high voltage controller 60C shown in FIG. 12 which is different from the third embodiment.

According to high voltage controller 60C, the output from 10-bit pseudorandom number generator 76 has its upper 4 bits made by reversing the order of the 4 bits of counter 76*b* and its lower 6 bits made by pseudorandom number generator 76*a*. Accordingly, comparison unit 63-2B compares 10-bit pseudorandom number generator 76 with the lower 10 bits of 19-bit register 67 and outputs select signal SELECT to frequency-divide selector 69, and then such selector 69 switches between the two frequency-divide ratios. Except for using the random number that is to be input to comparison unit 63-2B, other operations are the same as the third embodiment.

(Modifications of Fourth Embodiment)

The fourth embodiment can be modified to the following examples (a), (b), or the like.

(a) Although 10 bit pseudorandom number generator 76 is composed of a combination of 4-bit counter 76*b* and 6-bit pseudorandom number generator 76*a* of LFSR in the fourth embodiment, pseudorandom number generator 76 may be composed of 6-bit LFSR if 19-bit register 67 serving as a frequency-divide ratio instructing unit has a 6-bit fractional part.

(b) Other methods may be used such as using a random number generator other than LFSR, applying random numbers to a table of a threshold matrix, or the like.

(Effects of Fourth Embodiment)

The fourth embodiment uses random numbers for the threshold matrix in the binarization process. This reduces bias of the frequency-divide ratios in response to the variation of the frequency-divide ratio instruction value of 19-bit register 67. Therefore the fourth embodiment can output the high voltage output that has small ripple changes even though the frequency-divide ratio instruction value varies, thereby enabling the stable high voltage output by the digital control.

[Fifth Embodiment]

(Configuration of the Fifth Embodiment)

A fifth embodiment of the invention has the same configurations as in image forming apparatus 1 of FIG. 3, the control circuit of FIG. 4, transfer high voltage power supply 90 of FIG. 1, and piezoelectric transformer driving device 80 of FIG. 2 that are the same configuration as the third embodiment. The fifth embodiment has a high voltage controller that is different configuration from that of the third embodiment and provided in piezoelectric transformer driving device 80.

Figure 14:
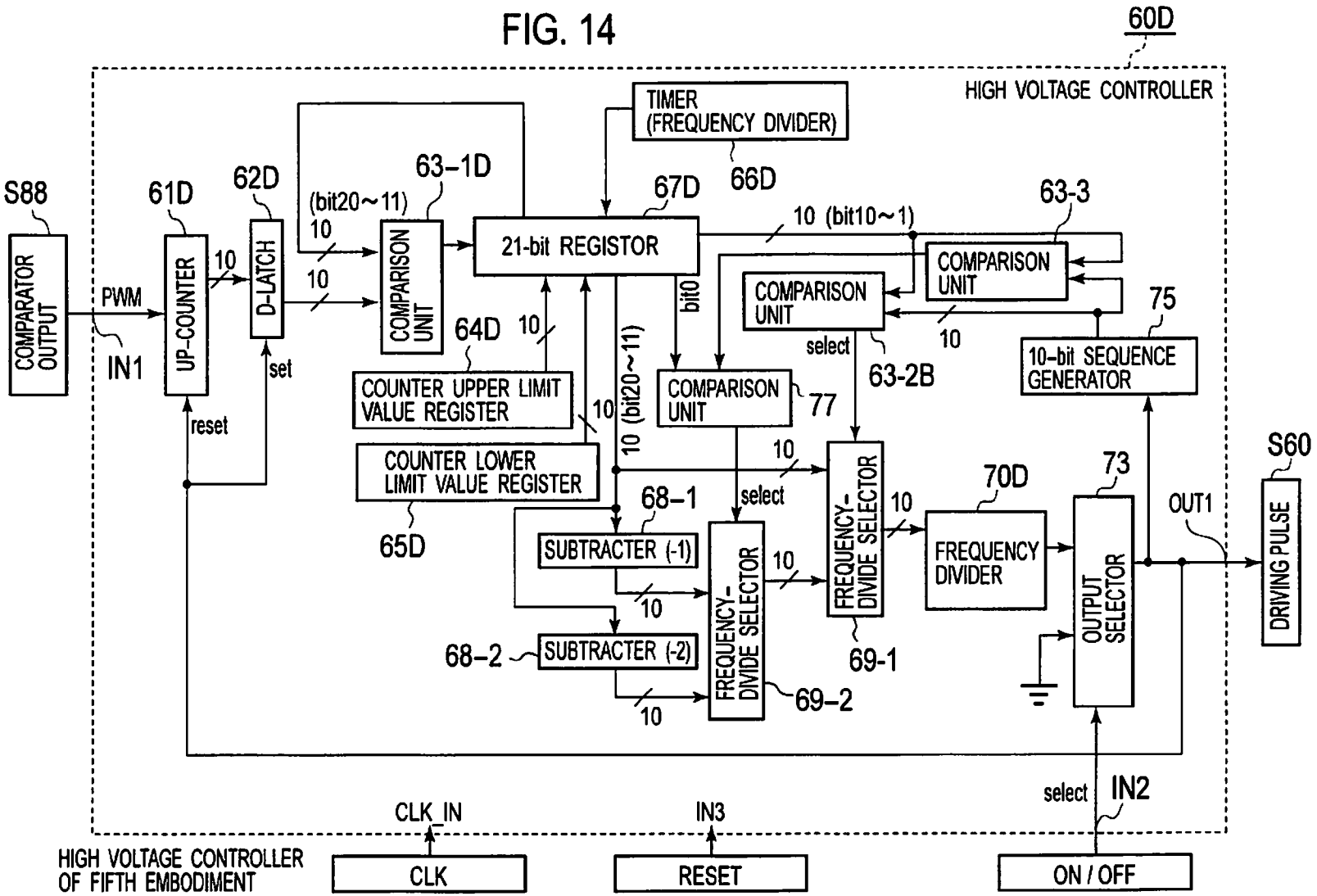
FIG. 14 is a block diagram of a high voltage controller in a piezoelectric transformer-driving device according to a fifth embodiment of the invention.

FIG. 14 is a block diagram of the high voltage controller in piezoelectric transformer driving device 80 according to the fifth embodiment of the invention. In the fifth embodiment, the same configurations as in FIG. 11 of the third embodiment are designated by the same reference numerals.

High voltage controller 60D of the fifth embodiment has up-counter 61D, D-latch 62D, comparison units 63-1D, 63-3 and 63-2B, counter upper limit value register 64D, counter lower limit value register 65D, timer (frequency divider) 66D, 21-bit register 67D, subtracter (−1) 68-1, subtracter (−2) 68-2, frequency-divide selectors 69-1 and 69-2, frequency divider 70D and AND gate 77 that have a function or configuration different from up-counter 61, D-latch 62, comparison unit 63-1, counter upper limit value register 64, counter lower limit value register 65, timer (frequency divider) 66, 19-bit register 67, subtracter (−1) 68, frequency-divide selector 69, and frequency divider 70 that are provided in high voltage controller 60B of the third embodiment.

Clock signal CLK supplied to high voltage controller 60D of the fifth embodiment has the frequency of 66.66 MHz (=15 nsec cycle) that is two times frequency of clock signal CLK (33.33 MHz) of the third embodiment. Up-counter 61D is a 10-bit counter having the same configuration as that of the third embodiment. That is, Up-counter 61D is upgraded to have 1-bit more than Up-counter 61 of the third embodiment, to hold a two times value in order to handle the frequency of clock signal CLK of the fifth embodiment that is three times as great as that of the third embodiment. D-latch 62D is a 10-bit latch which has the same configuration as D-latch 62 of the third embodiment except for the bit number.

Comparison unit 63-1D is a 10-bit comparison unit which has the same configuration as comparison unit 63-1 of the third embodiment except for the bit number. Comparison unit 63-1D compares D-latch 62D with the upper 10 bits of 21-bit register 67D and outputs the comparison result to 21-bit register 67D. Counter upper limit value register 64D is a 10-bit register which can hold a value up to 604 dec (=25 C hex) which is two times greater than that of the third embodiment. Counter lower limit value register 65D is a 10-bit register which can hold a value up to 604 dec (=25 C hex) which is two times greater than that of the third embodiment.

21-bit register 67D is a register that holds a frequency-divide ratio instruction value (that is, a frequency instruction value), in which the upper 10 bits represents the integer part and the lower 11 bits represents the fractional part of the frequency-divide ratio instruction value. The value of the lower 11 bits equals (11-bit value)/2048, which is a decimal. 21-bit register 67D can hold 1-bit more in the integer part and the fractional part than 21-bit register 67 of the third embodiment and the other configuration thereof has the same configuration as 19-bit register 67 of the third embodiment. 21-bit register 67D outputs the upper 10 bits to comparison unit 63-1D. 21-bit register 67D also outputs a 10 bits (bit [10] to bit [1]) of the lower 11 bits (bit [10] to bit [0]) to comparison unit 63-2B. 21-bit register 67D outputs the upper 10 bits to frequency-divide selector 69-1, subtracter (−1) 68-1 and subtracter (−2) 68-2, respectively. 21-bit register 67D outputs the lowest 1-bit thereof (=bit [0]) to AND gate 77. The process in response to inputs from Counter upper limit value register 64D and counter lower limit value register 65D is the same as third embodiment except for the bit number, that is, the fifth embodiment deals with 10 bits whereas the third embodiment deals with 9 bits.

Subtracter (−1) 68-1 inputs therein and subtracts one from the upper 10 bits (=bit [20] to [11]) of 21-bit register 67D and outputs the subtract value to frequency-divide selector 69-2. Subtracter (−2) 68-2 inputs therein and subtracts two from the upper 10 bits (=bit [20] to [11]) of 21-bit register 67D and outputs the subtract value to frequency-divide selector 69-2.

Frequency-divide selector 69-1 selects between the upper 10 bits of 21-bit register 67D and the 10 bits output from frequency-divide selector 69-2, based on select signal SELECT output from comparison unit 63-2B and outputs the selected one to frequency divider 70D. Namely, frequency-divide selector 69-1 selects the output signal of frequency-divide selector 69-2 when select signal SELECT output from comparison unit 63-2B is L" and selects the upper 10 bits (=bit [20] to [11]) of 21-bit register 67D when select signal SELECT is "H".

Frequency-divide selector 69-2 selects an output signal of subtracter (−1) 68-1 when select signal SELECT output from AND gate 77 is "H" and outputs it to frequency-divide selector 69-1, and selects an output signal of subtracter (−2) 68-2 when select signal SELECT is "L" and outputs it to frequency-divide selector 69-1. Note that a multinarization unit includes these subtracter (−1) 68-1, subtracter (−2) 68-2, and frequency-divide selectors 69-1 and 69-2.

AND gate 77 is a logic circuit that performs the AND operation on two inputs which are the lowest bit (=bit [0]) of 21-bit register 67D and the comparison result of comparison unit 63-3 and outputs one output which is select signal SELECT to frequency-divide selector 69-2. Comparison unit 63-3 is configured to compare a 10 bits input from 10-bit sequence generator with a 10-bits input (=bit [10] to bit [1]) from 21-bit register 67D. Comparison unit 63-3 outputs 1 (="H") to AND gate 77 when both 10-bits inputs are equal and outputs 0 (="L") in the other condition. Timer (frequency divider) 66D outputs pulse to 21-bit register 67D at the same cycle as the third embodiment, and the frequency-divide ratio is thus set as twice the third embodiment. Frequency divider 70D has the same configuration as frequency divider 70 of the third embodiment except for the bit number. That is, frequency divider 70D has 10 bits whereas frequency divider 70 has 9 bits.

(Operation of Fifth Embodiment)

In the fifth embodiment, general operation of image forming apparatus 1 is the same as that of the third embodiment. The following description is for an internal operation of high voltage controller 60D shown in FIG. 14 which is different from the third embodiment.

In high voltage controller 60D, each of up-counter 61D, D-latch 62D, comparison unit 63-1D, counter upper limit value register 64D, and counter lower limit value register 65D has one more bit than the third embodiment and thus has twice the value than the third embodiment. But other than that, those components perform the same operation as the third embodiment.

21-bit register 67D outputs the value of the upper 10 bits to frequency-divide selector 69-1, subtracter (−1) 68-1, and subtracter (−2) 68-2. For example, assuming that the value of the upper 10 bits is set to 590 dec, 589 dec and 588 dec are input to frequency-divide selector 69-2 and 590 dec is input to frequency-divide selector 69-1.

Since comparison unit 63-2B operates in the same way as the third embodiment, when the output signal of AND gate 77 is "L", 588 dec, which is the output from subtracter (−2) 68-2, is input to frequency-divide selector 69-1. Either 588 dec which is input to frequency-divide selector 69-1 through frequency-divide selector 69-2 or 590 dec which is the value of the upper 10 bits of 21-bit register 67D input directly to frequency-divide selector 69-1 is selected and input to frequency divider 70D to output the corresponding pulse from frequency divider 70D. That is, when the lowest bit of 21-bit register 67D is 0, the operation is the same as the third embodiment, except for the frequency of clock signal CAR of the fifth embodiment which is two times the third embodiment.

Since the comparison result of comparison unit 63-3 is "H" only if the value of bit [10] to bit [1] of 21-bit register 67D and the output value of 10-bit sequence generator are equal, when the lowest bit of 21-bit register 67D is 1, the output signal of AND gate 77 is switched to be "H" and thus frequency-divide selector 69-2 selects and outputs the output of subtracter (−1) 68-1. When the comparison result of comparison unit 63-3 is "H", the comparison result of comparison unit 63-2B is switched to be "L" as described in the third embodiment and frequency-divide selector 69-1 thus selects and outputs the output value of subtracter (−1) 68-1.

Assuming that the internal counter of 10-bit sequence generator takes 0, 1, 2, 3, and 4 in turn, the output value of 10-bit sequence generator will be 0, 512, 256, 768, and 128, in turn. For example, in the case where the upper 10 bits of 21-bit register 67D is 590 dec and the lower 11 bits of 21-bit register 67D is 0 dec (=000_0000_0000b), the frequency-divide ratio will be 588, 588, 588, 588, and 588, in turn. In the case where the upper 10 bits of 21-bit register 67D is 590 dec and the lower 11 bits of 21-bit register 67D is 1 dec (=000_0000_0001b), the frequency-divide ratio will be 589, 588, 588, 588, and 588, in turn. In the case where the upper 10 bits of 21-bit register 67D is 590 dec and the lower 11 bits of 21-bit register 67D is 2 dec (=000_0000_0010b), the frequency-divide ratio will be 590, 588, 588, 588, and 588, in turn.

As described above, the fifth embodiment adds one more bit to the integer part and the fractional part compared to the third embodiment and trinarizes the output pulse, thereby making the frequency resolution capability two times as great as that of the third embodiment. The operation of the other circuit components is the same as the third embodiment.

Note that although the fifth embodiment trinarizes the output pulse as a example of a multinarization process, however the invention can be applied to be the multinarization process (N-value generating process, N is integer number) such as a four-value generating process, five-value generating process, or the like.

(Effect of Fifth Embodiment)

The fifth embodiment trinarizes the frequency instruction value of 21-bit register 67D and thus makes the frequency resolution capability higher and improves the resolution capability of the high voltage output. The fifth embodiment achieves stable output voltage at a low load around the resonance frequency of piezoelectric transformer 85 and improves the controllability by the digital circuit.

[Sixth Embodiment]

(Configuration of Image Forming Apparatus)

Figure 15:
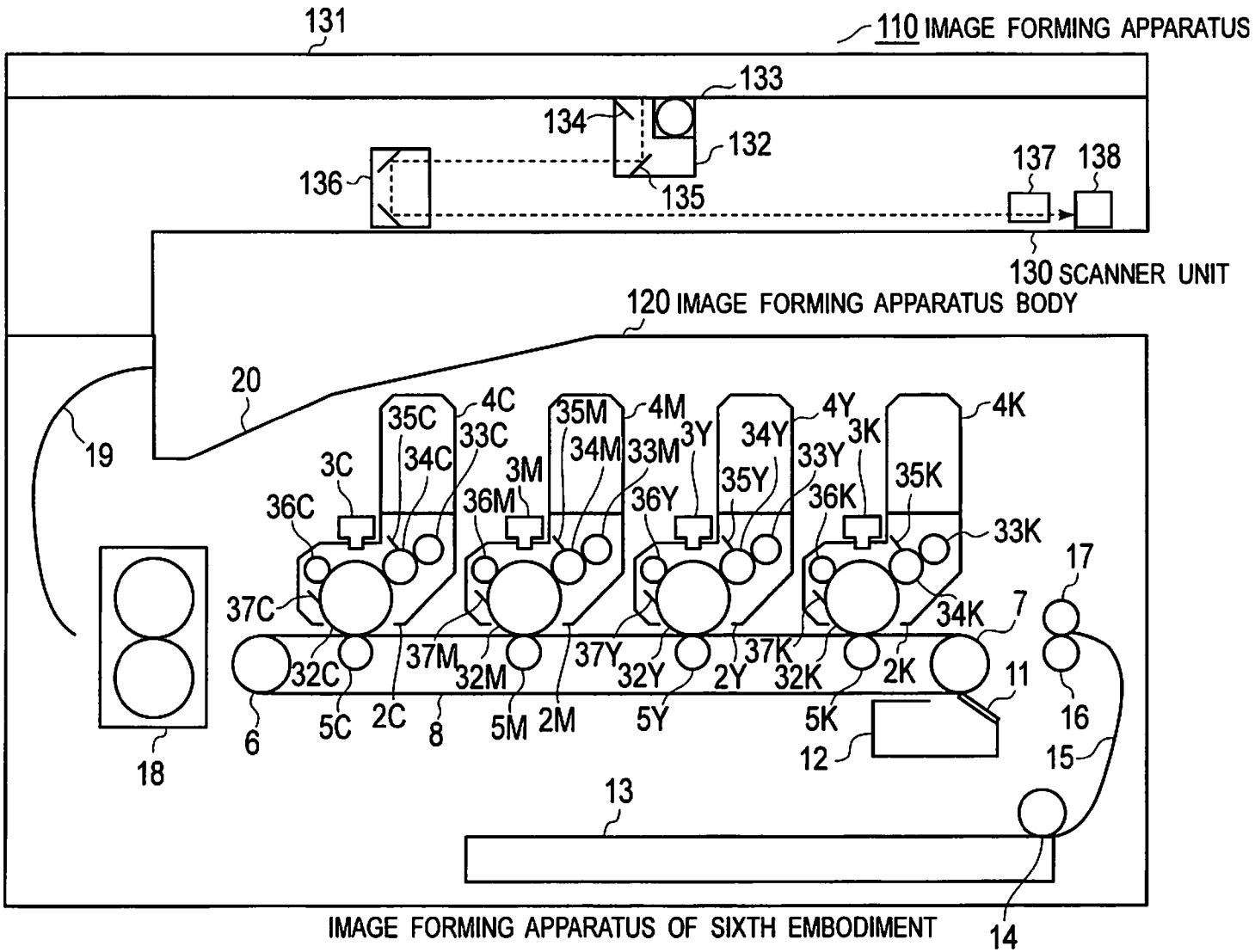
FIG. 15 is a block diagram of an image forming apparatus using a power supply device according to a sixth embodiment of the invention.

FIG. 15 is a block diagram of an image forming apparatus using a power supply device according to a sixth embodiment of the invention. In the sixth embodiment, the same configurations as those shown in FIG. 3 of the first embodiment are designated by the same reference numerals.

The image forming apparatus of the sixth embodiment is a multi-functional printer (MFP). The image forming apparatus has image forming apparatus body 120 which has the same configuration as image forming apparatus 1 according to the first embodiment (FIG. 3) and image read device 130 (for example, a scanner unit) equipped above image forming apparatus body 120.

Scanner unit 130 includes platen table 131 on which a document can be placed. Platen table 131 is mounted on image forming apparatus body 120. Cold-cathode tube supporting body 132 is attached under platen table 131. Cold-cathode tube supporting body 132 supports thereto cold-cathode tube 133, reflector 134 which reflects light emitted from cold-cathode tube 133 toward the document placed on platen table 133, and mirror 135. Mirror supporting body 136, lens 137, and image pickup device 138 (for example, charge-coupled device 138 (hereinafter "CCD") are also provided under platen table 131. Mirror supporting body 136 includes two mirror plates, which reflect light from reflector 134 to lens 137. Lens 137 focuses light from mirror supporting body 136 to CCD 138. CCD 138 converts the received light into an electrical signal.

Figure 16:
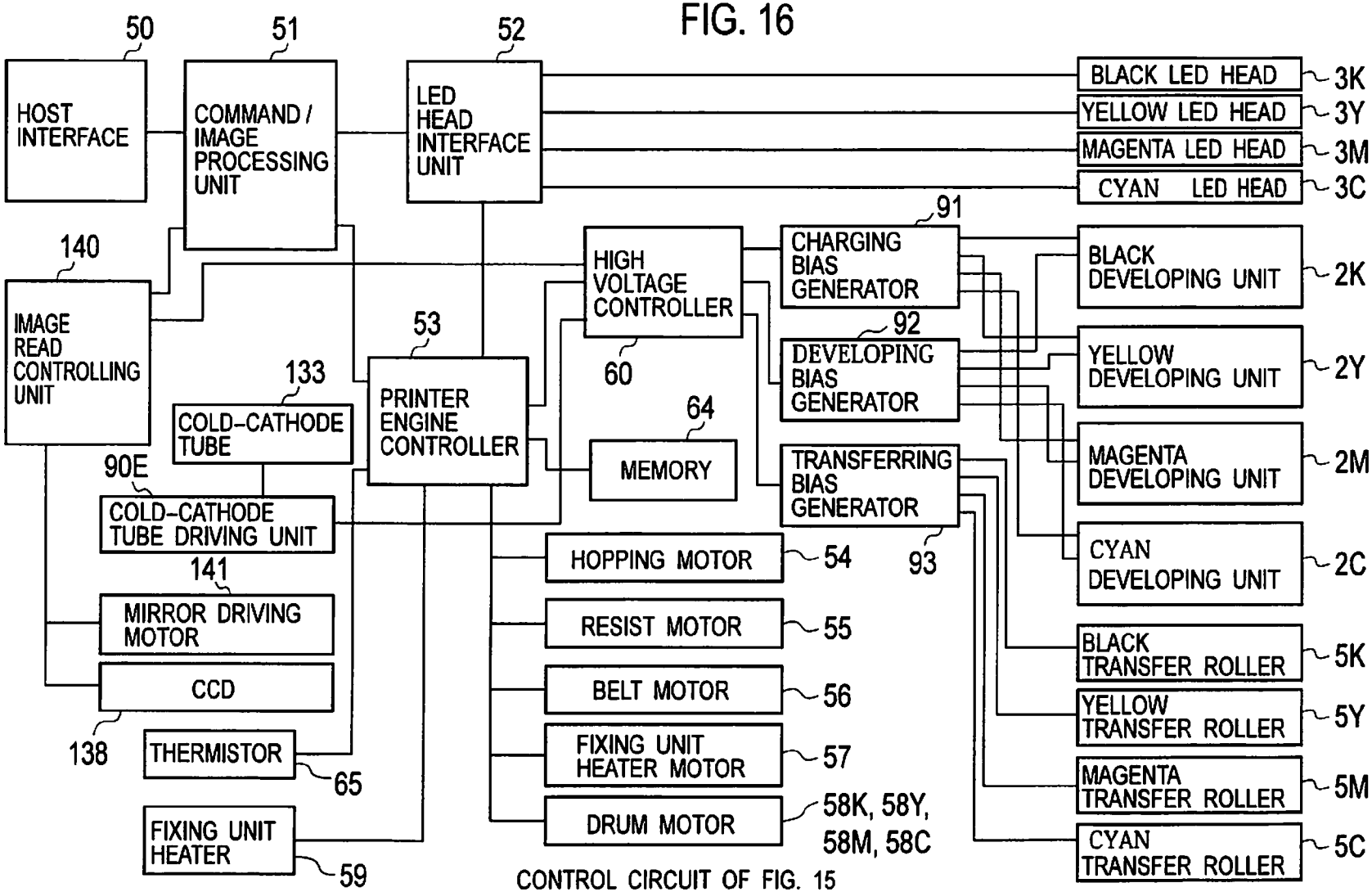
FIG. 16 is a block diagram of a configuration of the control circuit of image forming apparatus 110 of FIG. 15.

FIG. 16 is a block diagram of the configuration of a control circuit of image forming apparatus 110 shown in FIG. 15, and the same configurations as those shown in FIG. 4 of the first embodiment are designated by the same reference numerals.

The control circuit of this sixth embodiment has cold-cathode driving unit 90E, cold-cathode tube 133, CCD 138, image read controlling unit 140 and mirror driving motor 141, in addition to the configuration of the control circuit of the described first embodiment. Cold-cathode driving unit 90E is connected to high voltage controller 60 and is configured to drive cold-cathode tube 133. Image read controlling unit 140 is connected to command/image processing unit 51 and high voltage controller 60 and is configured to drive and control mirror driving motor 141, CCD 138, and the like.

(Configuration of Cold-Cathode Driving Unit)

Figure 17:
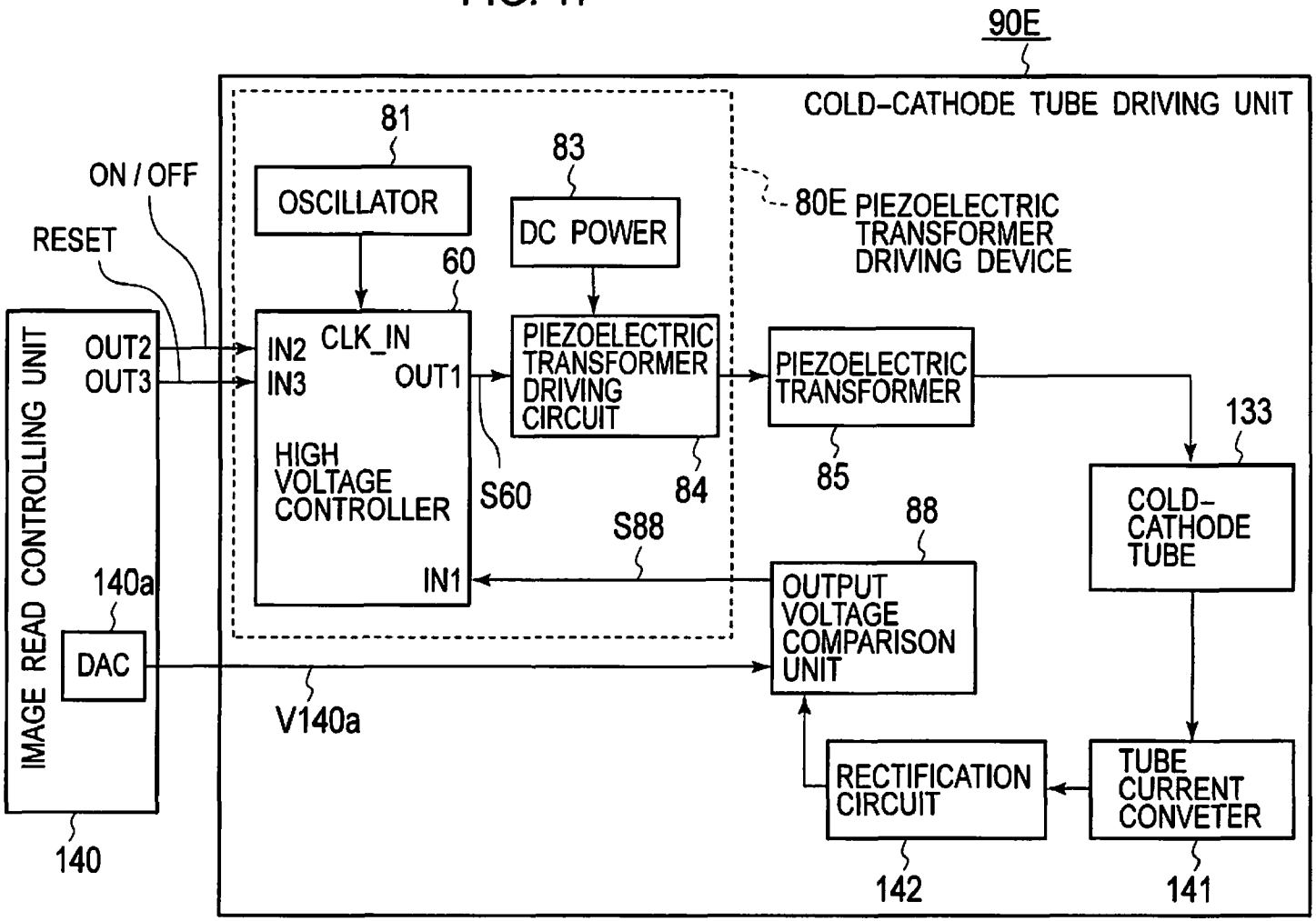
FIG. 17 is a block diagram of cold-cathode driving unit 90E having a piezoelectric transformer-driving device according to the sixth embodiment of the invention.

FIG. 17 is a block diagram of a cold-cathode driving power supply device for powering the cold-cathode (for example, cold-cathode driving unit 90E) having a piezoelectric transformer driving device according to the sixth embodiment of the invention. The same configuration as those shown in FIG. 1 of the first embodiment are designated by the same reference numerals.

Cold-cathode driving unit 90E shares high voltage controller 60 and oscillator 81 with transfer high voltage power supply 90 shown in FIG. 1 of the first embodiment. High voltage controller 60 has the same circuit configuration as the circuit shown in FIG. 6 of the first embodiment. The output and input of high voltage controller 60 are connected to DC power supply 83, cold-cathode tube inverter (for example, piezoelectric transformer driving circuit) 84, piezoelectric transformer 85, and output voltage comparison unit 88 or a voltage comparison unit having the same configuration as the first embodiment, and cold-cathode tube 133, tube current detector (for example, tube current converter) 141, and rectifier (for example, rectification circuit) 142 which have different configuration from those of the first embodiment.

DC power supply 83, piezoelectric transformer driving circuit 84, piezoelectric transformer 85, and output voltage comparison unit 88, have the same circuit configurations as those of the first embodiment, and thus are designated by the same reference numerals as the first embodiment, but are provided in cold-cathode driving unit 90E which is separately provided from transfer high voltage power supply 90 of the first embodiment. High voltage controller 60, oscillator 81, DC power supply 83, and piezoelectric transformer driving circuit 84 together form piezoelectric transformer driving device 80E of the sixth embodiment. Piezoelectric transformer 85 is connected to the output of piezoelectric transformer driving circuit 84. Cold-cathode tube 133, tube current converter 141, rectification circuit 142, and output voltage comparison unit 88 are serially connected to the output of piezoelectric transformer 85. Output voltage comparison unit 88 is connected to the output of DAC140*a* in image read controlling unit 140 and input port IN1 of high voltage controller 60.

Cold-cathode tube 133 is configured to emit light by the high voltage output of piezoelectric transformer 85. Tube current converter 141 is configured to detect a voltage of the tube current flowing through cold-cathode tube 133 and output the detected voltage. Rectification circuit 142 rectifies the detected voltage into DC voltage. Output voltage comparison unit 88 compares the DC voltage output from rectification circuit 142 with target voltage V140*a* output from a target voltage instructing unit (for example, DAC) 140*a* in image read controlling unit 140 and then outputs the comparison result S88 into input port IN1 of high voltage controller 60. Image read controlling unit 140 has output port OUT2 which outputs an ON/OFF signal to input port IN2 of high voltage controller 60, output port OUT3 which outputs reset signal RESET to input port IN3 of high voltage controller 60, variable voltage output circuit (for example, DAC having 10-bit resolution) 140*a*, serving as a target voltage setting unit, and outputting target voltage V140*a* with a predetermined range (for example, 3.3V) to output voltage comparison unit 88, and the like.

Figure 18:
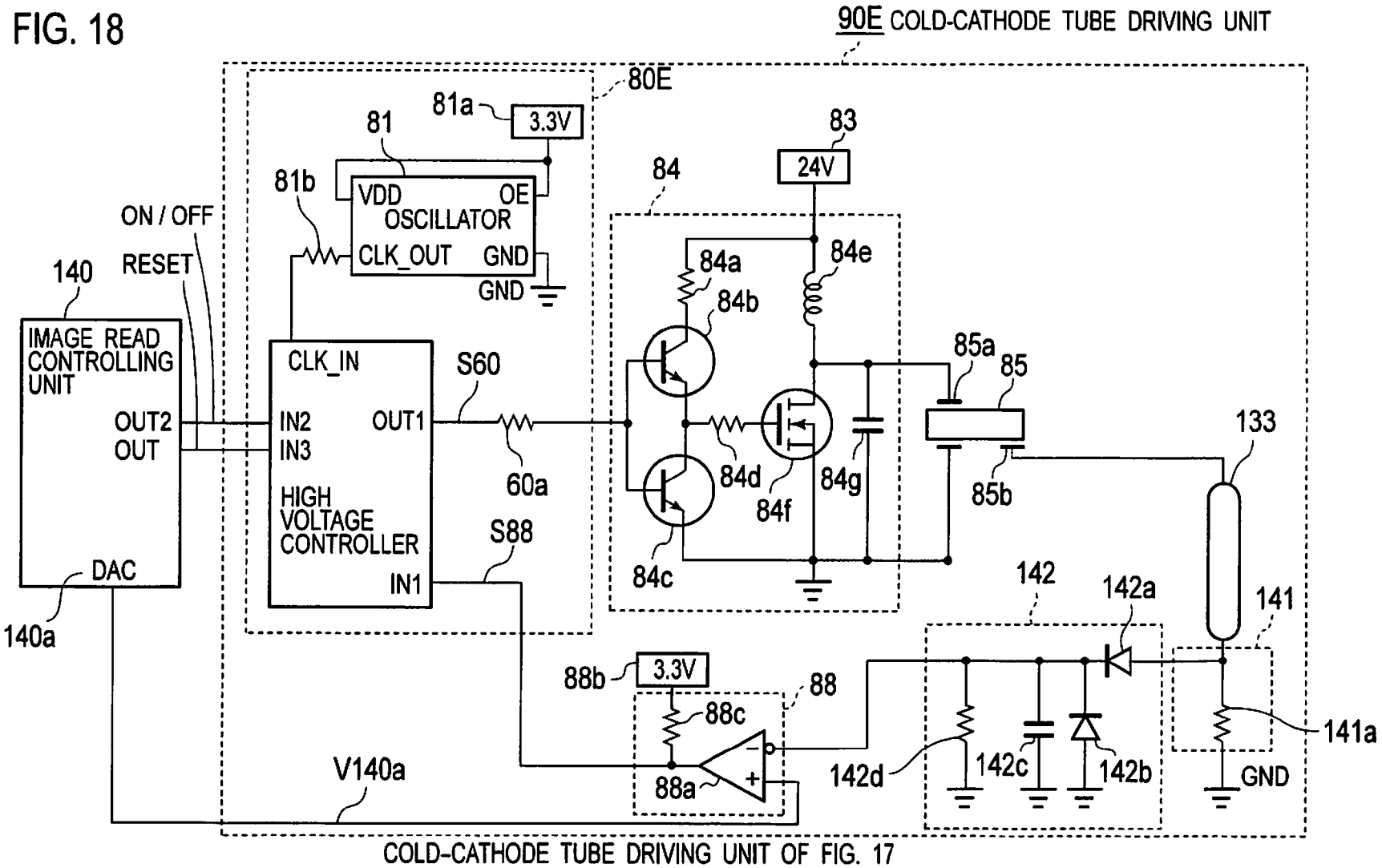
FIG. 18 is a circuit diagram of a detail configurational example of cold-cathode driving unit 90E of FIG. 17.

FIG. 18 is a circuit diagram of a detail configurational example of cold-cathode driving unit 90E shown in FIG. 17. The same configurations as those shown in FIG. 2 of the first embodiment are designated by the same reference numerals.

Tube current detector 141 is composed of resistor 141*a* which is connected between cold-cathode tube 133 and ground GND. Rectification circuit 142, which is connected to the output of tube current converter 141, is composed of diodes 142*a* and 142*b*, capacitor 142*c*, and resistor 142*d*. The other configurations are the same as or similar to those of transfer high voltage power supply 90 shown in FIG. 2 of the first embodiment.

(General Operation of Image Forming Apparatus)

In image forming apparatus 110 which is a multi-function printer shown in FIG. 15, image forming apparatus body 120 performs the same operation as image forming apparatus 1 of the first embodiment shown in FIG. 3.

In scanner unit 130, cold-cathode tube supporting body 132 and mirror supporting body 136 are moved to initial positions by a motor in platen table 131 during an initializing process. After a document to be scanned is placed on platen table 131, and in response to a copy instruction from an operator or like from an un-illustrated operational panel or the like, cold-cathode tube 133 is powered on to emit light and cold-cathode tube supporting body 132 and mirror supporting body 136 are driven at a predetermined time, so as to expose the document. The light reflected from the document is received by CCD 137 through lens 137 via mirror 135 and mirror supporting body 136.

The light received by CCD 138 is converted to digital data by image read controlling unit 140 of FIG. 16, and the digital data is transmitted to command/image processing unit 51, and then command/image processing unit 51 converts the digital data into image data. After the process for scanning the document is completed, cold-cathode driving unit 90E turns off cold-cathode tube 133.

(Operation of Cold-Cathode Driving Unit)

Figure 19:
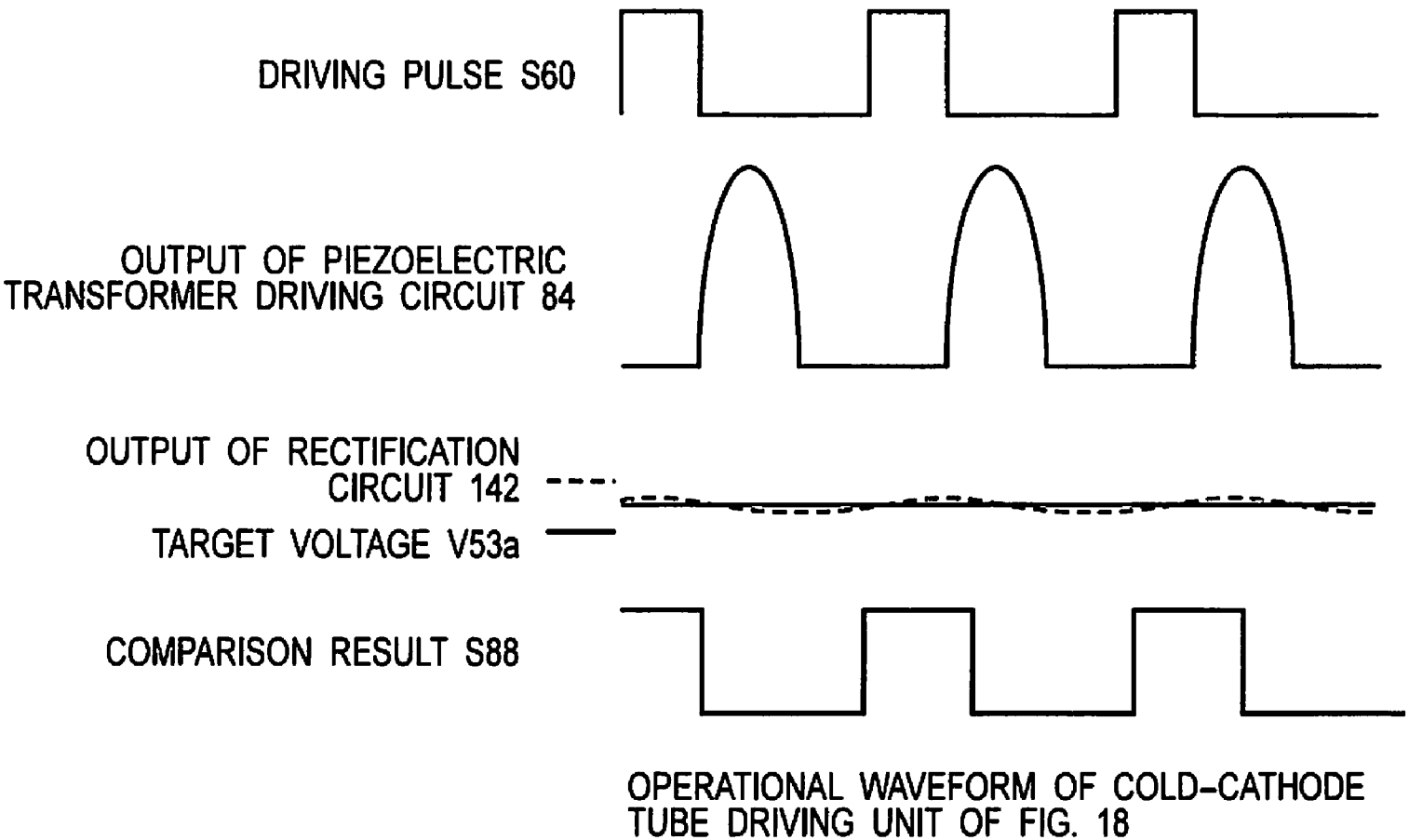
FIG. 19 is a waveform diagram of an operation of cold-cathode driving unit 90E of FIG. 18.

FIG. 19 is waveform of an operation of cold-cathode driving unit 90E of FIG. 18.

Similar to transfer high voltage power supply 90 of the first embodiment, piezoelectric transformer 85 starts to drive at the starting frequency-divide ratio. Before powering on cold-cathode tube 133, the tube current flow is low so that the output voltage of tube current converter 141 and the output voltage of rectification circuit 142 are nearly 0 V. Target voltage V140*a*, which corresponds to the tube current during powering of cold-cathode tube 133, is input from DAC 140*a* to output voltage comparison unit 88 and comparison result S88 of "H" is thus input to the input port IN1 of high voltage controller 60. Similar to the first embodiment, the frequency of driving pulse S60, which is input to piezoelectric transformer driving circuit 84, is decreased until the tube current reaches a predetermined level. After tube current of powered scold-cathode tube 133 reaches to the predetermined level, comparison result S88 of output voltage comparison unit 88 takes "H" and "L" in turn as shown in FIG. 19, and therefore the driving frequency and the tube current are stable.

Next, with reference to FIG. 6, operation of the internal circuit of high voltage controller 60 will be described. General operation of the internal circuit is similar to the first embodiment, and the following description is thus only for operations that are different from the first embodiment.

Counter lower limit value register 65 holds 320 dec, counter upper limit value register 64 holds 330 dec. These set values are different from the first embodiment, since a current for the load (cold-cathode tube 133) in the present embodiment is greater than that of transfer high voltage power supply 90 in the second embodiment. When the value of the upper 9 bits in 19-bit register 67 exceeds the counter upper limit value upon counting-up, 19-bit register 67 inputs the value of counter lower limit value register 65 to the upper 9 bits and clears the lower 10 bits to 0. In other words, in the sixth embodiment, the upper 9-bit value is controlled to be reset to the lower limit value which is the start frequency when the upper 9-bit value reaches the counter upper limit value, although in the first embodiment the counter upper limit value is controlled such that the upper 9-bit value does not rise above the counter upper limit value. The other circuit components perform in the same way as the first embodiment. In response to the ON/OFF signal input to high voltage controller 60A, cold-cathode tube 133 is controlled to be turned on or off.

Note that although the sixth embodiment set target voltage V140*a*, which corresponds to the target current by using DAC 140*a*, it can be set by other means such as a constant-voltage source zener diode or the like.

(Effect of Sixth Embodiment)

According to the sixth embodiment, cold-cathode tube 133 can be controlled by digital control instead of a conventional analog control. Further, according to the sixth embodiment, the power supply device for image forming and the power supply device for cold-cathode power can share high voltage controller 60, which is one integrated circuit in the multi-functional printer.

[Seventh Embodiment]

(Configuration of Seventh Embodiment)

An image forming apparatus of a seventh embodiment of the invention has a configuration in which image forming apparatus 110 shown in FIG. 15 of the sixth embodiment is combined with high voltage controller 60A shown in FIG. 9 of the second embodiment.

(Operation of Seventh Embodiment)

The following description is for the part of the operation of the image forming apparatus of the seventh embodiment that is different from the second embodiment.

In high voltage controller 60A of FIG. 9, counter lower limit value register 65 holds 320 dec, counter upper limit value register 64 holds 330 dec. These set values are different from the second embodiment, since a current for the load (cold-cathode tube 133) in the present seventh embodiment is greater than a current for the load of transfer high voltage power supply 90 in the second embodiment.

When the value of the upper 9 bits in 19-bit register 67 exceeds the counter upper limit value upon counting-up, the value of counter lower limit value register 65 is input to the upper 9 bits and the lower 10 bits is cleared to 0. In other words, in the present seventh embodiment, the upper 9-bit value is controlled to be reset to the lower limit value which is the start frequency when the upper 9-bit value reaches the counter upper limit value, although in the second embodiment the counter upper limit value is controlled such that the upper 9-bit value does not rise above the counter upper limit value. The other circuit components perform in the same way as the second embodiment. In response to the ON/OFF signal input to high voltage controller 60A, cold-cathode tube 133 is controlled to be turned on or off.

(Effect of Seventh Embodiment)

According to the seventh embodiment, the error variance of the frequency-divide ratios for driving pulse S60 is diffused into many pulses upon driving cold-cathode tube 133. This enables stable lighting of cold-cathode tube 133 using the digital circuit.

[Eighth Embodiment]

(Configuration of Eighth Embodiment)

An image forming apparatus of eighth embodiment of the invention has a configuration in which image forming apparatus 110 of the sixth embodiment shown in FIG. 15 is combined with high voltage controller 60B of the third embodiment shown in FIG. 11.

(Operation of Eighth Embodiment)

The following description is for apart of the operation of the image forming apparatus of the eighth embodiment that is different from the third embodiment.

In high voltage controller 60B of FIG. 11, counter lower limit value register 65 holds 320 dec and counter upper limit value register 64 holds 330 dec. These set values are different from the third embodiment, since the current for the load (cold-cathode tube 133) in the present eighth embodiment is greater than the current for the load of transfer high voltage power supply 90 in the third embodiment. When the value of the upper 9 bits in 19-bit register 67 exceeds the counter upper limit value upon counting-up, the value of counter lower limit value register 65 is input to the upper 9 bits in 19-bit register 67 and the lower 10 bits in 19-bit register 67 is cleared to 0. In other words, in the eighth embodiment, the upper 9-bit value is controlled to be reset to the lower limit value which is the start frequency when the upper 9-bit value reaches the counter upper limit value, although in the third embodiment the counter upper limit value is controlled such that the upper 9-bit value does not rise above the counter upper limit value. The other circuit components perform in the same way as the third embodiment. In response to the ON/OFF signal input to high voltage controller 60B, cold-cathode tube 133 is controlled to be turned on or off.

(Effect of Eighth Embodiment)

The eighth embodiment enables the digital circuit to achieve stable lighting of cold-cathode tube 133.

[Ninth Embodiment]

(Configuration of Ninth Embodiment)

An image forming apparatus of a ninth embodiment of the invention has a configuration in which image forming apparatus 110 of the sixth embodiment shown in FIG. 15 is combined with high voltage controller 60C of the fourth embodiment shown in FIG. 12.

(Operation of Ninth Embodiment)

The following description is for a part of the operation of the image forming apparatus of the ninth embodiment that is different from the fourth embodiment.

In high voltage controller 60C of FIG. 12, counter lower limit value register 65 holds 320 dec and counter upper limit value register 64 holds 330 dec. These set values are different from the fourth embodiment, since a current for the load (cold-cathode tube 133) in the present embodiment is greater than a current for the load of transfer high voltage power supply 90 in the fourth embodiment. When the value of the upper 9 bits in 19-bit register 67 exceeds the counter upper limit value upon counting-up, the value of counter lower limit value register 65 is input to the upper 9 bits in 19-bit register 67 and the lower 10 bits in 19-bit register 67 is cleared to 0. In other words, in the present embodiment, the upper 9-bit value is controlled to be reset to the lower limit value which is the start frequency when the upper 9-bit value reaches the counter upper limit value, although in the fourth embodiment the counter upper limit value is controlled such that the upper 9-bit value does not rise above the counter upper limit value. The other circuit components perform in the same way as the fourth embodiment. In response to the ON/OFF signal inputted to high voltage controller 60C, cold-cathode tube 133 is controlled to be turned on or off.

(Effect of Ninth Embodiment)

The ninth embodiment enables the digital control to achieve stable lighting of cold-cathode tube 133.

[Tenth Embodiment]

(Configuration of Tenth Embodiment)

An image forming apparatus according to a tenth embodiment of the invention has a configuration in which image forming apparatus 110 of the sixth embodiment shown in FIG. 15 and high voltage controller 60D of the fifth embodiment shown in FIG. 14 are combined.

(Operation of Tenth Embodiment)

The following description will is for a part of the operation of the image forming apparatus of the tenth embodiment that is different from the fifth embodiment.

In high voltage controller 60D of FIG. 14, counter lower limit value register 65D holds 640 dec and counter upper limit value register 64D holds 660 dec. These set values are different from the fifth embodiment, since a current for the load (cold-cathode tube 133) in the tenth embodiment is greater than a current for the load of transfer high voltage power supply 90 in the fifth embodiment. When the value of the upper 10 bits in 21-bit register 67D exceeds the counter upper limit value upon counting-up, the value of counter lower limit value register 65D is input to the upper 10 bits in 21-bit register 67D and the lower 11 bits in 21-bit register 67D is cleared to 0. In other words, in the tenth embodiment, the upper 10-bit value is controlled to be reset to the lower limit value which is the start frequency when the upper 10-bit value reaches the counter upper limit value, although in the fifth embodiment the counter upper limit value is controlled such that the upper 10-bit value does not rise above the counter upper limit value. The other circuit components perform in the same way as the fifth embodiment. In response to the ON/OFF signal inputted to high voltage controller 60D, cold-cathode tube 133 is controlled to be turned on or off.

(Effect of Tenth Embodiment)

The tenth embodiment enables the digital control to achieve stable lighting of cold-cathode tube 133.

(Other Modification of First to Tenth Embodiments)

Although, in the first to fifth embodiments, transfer high voltage power supply 90 is in a color tandem type image forming apparatus 1 the invention can be applied to other high voltage power supplies for charging or the like. The invention can be applied not only to a color image forming apparatus but also a monochrome image forming apparatus or the like, and can be applied to other image forming apparatus such as MFP (multi-function printer) or the like. Similarly, in the sixth to tenth embodiments, cold-cathode driving unit 90E in image forming apparatus 110 of MFP (multi-function printer) is used for image scanning, the invention can be applied to other intended purposes such as LCD backlight or the like.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. A piezoelectric transformer driving device, comprising:

an oscillator configured to generate a clock signal;

a frequency-divider configured to output a pulse by dividing the clock signal by a received frequency-divide ratio;

a switching element configured to be driven by the pulse and to intermittently apply a voltage to a primary side of a piezoelectric transformer so as to output a high voltage alternating current from a secondary side of the piezoelectric transformer;

a frequency-divide ratio instructing unit configured to hold a frequency-divide ratio instruction value of a real number having an integer part and a fractional part;

a binarization unit configured to binarize the frequency-divide ratio instruction value into two different integer frequency-divide ratios $\alpha$ and $\beta$ and to selectively output the frequency-divide ratios $\alpha$ or $\beta$, wherein the binarization unit adjusts an appearance ratio of the frequency-divide ratios $\alpha$ and $\beta$ such that a fractional part of an average value per unit time of the frequency-divide ratio output from the binarization unit is equal to the fractional part of an average value per unit time of the frequency-divide ratio instruction value.

2. The piezoelectric transformer driving device according to claim 1, wherein the relationship between the integer number $\alpha$ and the integer number $\beta$ is $\alpha+1=\beta$.

3. The piezoelectric transformer driving device according to claim 1, wherein the binarization unit binarizes the frequency-divide ratio using an error diffusion method.

4. The piezoelectric transformer driving device according to claim 3, wherein the binarization unit allocates an error value that is generated at the $M^{th}$ binarization only to the $(M+1)^{th}$ binarization, M being a positive integer number.

5. The piezoelectric transformer driving device according to claim 1, wherein the binarization unit performs the binarization using a threshold matrix.

6. The piezoelectric transformer driving device according to claim 5, further comprising a counter configured to count the pulse that is output from the frequency-divider, wherein the counter or a rearrangement of the order of bits in the counter forms the threshold matrix.

7. The piezoelectric transformer driving device according to claim 5, further comprising: a pseudorandom number generator configured to generate a pseudorandom number that is changed at each pulse output from the frequency-divider, wherein the pseudorandom number generator forms the threshold matrix.

8. The piezoelectric transformer driving device according to claim 1, wherein an image forming apparatus generates a high voltage for operating at least one image forming component.

9. An image forming apparatus comprising:

the piezoelectric transformer driving device according to claim 8; and an image read device including one of a cold-cathode driving power supply a cold-cathode tube driving device, wherein an integrated circuit outputs a pulse that drives the piezoelectric transformer of the image forming power supply and a pulse that drives the piezoelectric transformer of the one of the cold-cathode driving power supply and a cold-cathode tube driving device.

10. The image forming apparatus according to claim 9, wherein the image forming apparatus is a multi-functional printer.

11. The piezoelectric transformer driving device according to claim 1, wherein a cold-cathode tube inverter comprises a cold-cathode tube.

12. The piezoelectric transformer driving device according to claim 11, comprising:

a tube current detector configured to detect a voltage of an electric current flowing through a cold-cathode tube and to output the detected voltage;

a rectifier configured to output a DC voltage by rectifying the detected voltage;

a target voltage instructing unit configured to output a target voltage; and a voltage comparison unit configured to compare the DC voltage output from the rectifier with the target voltage output from target voltage instructing unit and to output the comparison result, wherein the frequency-divide ratio of the frequency-divide ratio instructing unit is controlled such that the comparison result is a rectangular wave.

13. The piezoelectric transformer driving device according to claim 11, wherein a cold-cathode driving power supply having a cold-cathode tube inverter to generates a high voltage for lighting the cold-cathode.

14. A piezoelectric transformer driving device, comprising:

an oscillator configured to generate a clock signal; a frequency-divider configured to generate a pulse by dividing the clock signal by a frequency-divide ratio that is received by the frequency-divider;

a switching element configured to be driven by the pulse and to intermittently apply a voltage to a primary side of a piezoelectric transformer so as to output a high voltage alternating current from a secondary side of the piezoelectric transformer;

a frequency-divide ratio instructing unit configured to hold a frequency-divide ratio instruction value of a real number having an integer part and a fractional part; and a multinarization unit configured to convert the frequency-divide ratio instruction value into three or more different integer frequency-divide ratios and to selectively output the frequency-divide ratios such that an average of the frequency-divide ratios output from the multinarization unit is equal to the frequency-divide ratio instruction value.

* * * * *